US006894211B2

(12) United States Patent
Asahi

(10) Patent No.: US 6,894,211 B2
(45) Date of Patent: May 17, 2005

(54) KEYBOARD APPARATUS

(75) Inventor: Yasuhiko Asahi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 30 days.

(21) Appl. No.: 10/247,599

(22) Filed: Sep. 19, 2002

(65) Prior Publication Data

US 2003/0056634 A1 Mar. 27, 2003

(30) Foreign Application Priority Data

Sep. 21, 2001 (JP) ..... 2001-288429
Sep. 21, 2001 (JP) ..... 2001-288430
Sep. 21, 2001 (JP) ..... 2001-288431
Sep. 21, 2001 (JP) ..... 2001-288433

(51) Int. Cl.[7] ..... G10C 3/12
(52) U.S. Cl. ..... 84/423 R; 84/431; 84/432; 84/427; 84/176
(58) Field of Search ..... 84/423 R, 431, 84/432, 427, 174, 176

(56) References Cited

U.S. PATENT DOCUMENTS 3,750,516 A * 8/1973 Olson ..... 84/470 R
3,797,357 A 3/1974 Thomas et al.
4,378,881 A * 4/1983 de Vries ..... 206/314
5,463,925 A * 11/1995 Galocy ..... 84/423 R
6,259,006 B1 * 7/2001 Parienti ..... 84/171

FOREIGN PATENT DOCUMENTS

JP 61-76493 5/1986

* cited by examiner

*Primary Examiner*—Shih-Yung Hsieh
(74) *Attorney, Agent, or Firm*—Morrison & Foerster LLP

(57) ABSTRACT

There is provided a keyboard apparatus which has a high durability, portability, and operability, and facilitates adaptation to a wide range of musical scenes and to multi-model production. Each adjacent pair of four main cases are pivotally connected to each other via connecting portions, whereby the main cases are allowed to assume a folded position which enables the keyboard apparatus to be carried with ease, and a flat unfolded position in which the keyboard can be played. Each main case has a keyboard unit arranged therein. Three main cases for lower tone ranges each have four white keys arranged therein, and a main case for a highest tone range has three white keys arranged therein, and a total of 25 keys are arranged on the keyboard apparatus. The main case for the highest tone range also has a group of operating elements arranged therein.

22 Claims, 13 Drawing Sheets

A - A

KEYBOARD APPARATUS

BACKGROUND OF THE INVENTION

1. Field of the Invention

The present invention relates to a small-sized keyboard apparatus which is suitable for mobile use.

2. Description of the Related Art

Conventionally, a keyboard apparatus is known which is small-sized for the convenience of mobile use. In general, a keyboard apparatus has a shape elongated in a direction in which keys are juxtaposed (in a lateral direction) (hereinafter referred to as "the direction of the row of keys) by its nature. Methods have been devised to reduce the size of the apparatus, including a method of configuring the apparatus as a folding type or a method of configuring the same as a roll-up type. For example, a folding type electronic keyboard apparatus is configured as disclosed in Japanese Laid-Open Utility Model Publication (Kokai) No. 61-76439 such that a keyboard section thereof is formed of a thin sheet, and the keyboard apparatus can be folded into a compact shape by folding the keyboard section at a dividing portion located between white keys without black keys interposed therebetween (between an E key and an F key, or between a G key and a C key) such that folded opposite portions of the top side of the keyboard or folded opposite portions of the back side of the same are faced and overlaid with each other.

However, when a folding member in general is folded, the inside (trough) of a bent portion (dividing portion) thereof is compressed and the outside (crest) of the same is expanded. This property or phenomenon is essentially possessed by a folding member unless the folding member has a thickness of zero which is actually impossible. Therefore, to actually manufacture the conventional keyboard apparatus, it is necessary to form a keyboard proper, which forms a sheet-shaped section, of a resilient material. This restrains the freedom of choice of materials. Further, even if the keyboard is formed of a resilient material, compared with an ordinary type (not a folding or roll-up type), it is low in rigidity and durability and limited in key stroke, which degrades the operability thereof. Further, since in the conventional keyboard apparatus, the keyboard is folded at the dividing portion by making use of the resiliency of the material of the sheet-shaped section, the dividing portion (folding portion) may develop a folded fatigue which can progressively affect the use's operation for performance, and the folding portion becomes lower in durability than the other portions. This impairs the balance of operability of keys. Further, the use of the resilient sheet makes it difficult to use a performance technique, such as glissando, and hence the operability of the keyboard apparatus is low from the start of use thereof. Thus, the conventional keyboard apparatus has problems in operability, rigidity, and durability.

Further, in the conventional keyboard apparatus, since folding thereof is performed between white keys without black keys interposed therebetween, the number of white keys arranged on one of keyboard units into which the keyboard is divided is three or four, and further, keys are necessarily arranged in such a pattern that the numbers of white keys in keyboard units are 3, 4, 3, 4, . . . , from the lowest tone range side. However, due to the difference in the number of white keys between the keyboard units, the keyboard units cannot be made uniform in length in the direction of the row of keys, so that the keyboard apparatus cannot be made sufficiently compact in size in the direction of the row of keys when it is folded, which leaves room in improvement in portability of the apparatus.

Incidentally, the aforementioned pattern of ". . . 3, 4, 3, 4, . . . " in the number of white keys is also a requirement for molding an ordinary (not portable) keyboard apparatus. More specifically, in molding key units each having a plurality of keys integrally formed thereon, the key units are considered to be preferably divided between white keys without black keys interposed therebetween as described above so as to avoid the inconvenience that ribs of molds have excessively long thin portions which correspond to portions between keys. However, in designing a portable keyboard apparatus, thin ribs of the mold do not present a substantial problem since keys are formed to be thin and hence the ribs of the molds are low in height. What is more, since the key unit is thin, it can be manufactured by blanking a plate material or the like method, which makes it practically unnecessary to consider the above-described limitation to be imposed by molding. Consequently, it is considered unnecessary to stick to the above-mentioned pattern of ". . . , 3, 4, 3, 4, . . . ".

Further, in reducing the size of the keyboard apparatus, it is desirable that the apparatus can be adapted to a wide range of musical scenes, in other words, to secure a minimum required number of keys or a minimum tone range necessary for a wide range of tunes, and prevent the use of the apparatus from being too limited. The minimum required number of keys considered to satisfy this requirement is preferably 20, 24, 25 or so in terms of the total of white and black keys. For example, in the case of 20 keys, a C key-to-F key arrangement in which the lowest tone corresponds to a C key and the highest tone corresponds to an F key can cover a required tone range necessary for a large number of tunes and has little inconvenience in performance. Similarly, in the case of 24 keys, it is preferred to employ an F key-to-E key arrangement in which that the lowest tone corresponds to an F key and the highest tone corresponds to an E key or a C key-to-B key arrangement in which the lowest tone corresponds to a C key and the highest tone corresponds to a B key. In the case of 25 keys, it is preferred to employ an F key-to-F key arrangement in which the lowest tone corresponds to an F key and the highest tone corresponds to an F key or a C key-to-C key arrangement in which the lowest tone corresponds to a C key and the highest tone corresponds to a C key. On the other hand, a key arrangement of 21 keys, 22 keys, or 23 keys has few advantages, and considered unpreferable from the viewpoint of effective use of limited space of the small-sized keyboard apparatus.

Further, also in arranging operating elements other than the keys, which are used for effects and the like, the layout thereof is required to be designed at the minimum cost of the portability and operability of the keyboard apparatus. Further, from the viewpoint of production, it is desirable to design the keyboard apparatus such that the number of kinds of components is reduced by using as many common or identical components as possible.

Further, due to the importance being laid on all of durability, portability, and operability, the keyboard apparatus is complicated in construction and difficult to manufacture.

Moreover, the portable keyboard apparatus tends to be narrower in tone range due to the minimized number of available keys. To compensate for this tendency, it is contemplated to provide a key range shift operating element for changing the pitch of a tone generated by depression of each key. In disposing this operating element, consideration is required so as to prevent the portability and operability of the apparatus from being degraded and the apparatus from becoming complicated in construction to no purpose.

Further, to generate tones according to depression of keys of the portable and small-sized keyboard apparatus, the keyboard apparatus is sometimes connected to another device or apparatus having an amplifier function. However, if it is desired to cause even the keyboard apparatus alone to generate simple tones, it is necessary to provide the keyboard apparatus with an acoustic transducer means, such as speakers. The acoustic transducer means is required to be disposed by designing such that the acoustic transducer means does not become a hindrance to reduction of the size of the keyboard apparatus so as to enhance the portability.

SUMMARY OF THE INVENTION

It is a first object of the present invention to provide a keyboard apparatus which has a high durability, portability, and operability, and can be easily adapted to a wide range of musical scenes and multi-model production.

It is a second object of the present invention to provide a keyboard apparatus which is capable of enhancing portability by a minimized thickness of the keyboard while preserving a high durability and operability.

It is a third object of the present invention to provide a keyboard apparatus which can be manufactured easily while preserving a high durability, portability, and operability.

It is a fourth object of the present invention to provide a keyboard apparatus which is capable of covering a wide range of musical tones with a reduced number of keys and by a simple key range shift operation while preserving a high durability, portability, and operability.

It is a fifth object of the invention to provide a keyboard apparatus which is capable of enabling generation of tones by depression of keys while preserving a high durability, portability, and operability.

It is a sixth object of the present invention to provide a keyboard apparatus which has a high durability, portability, and operability.

To attain the first object, according to a first aspect of the present invention, there is provided a keyboard apparatus comprising a plurality of keys arranged in a row, four frames each having part of the keys arranged thereon, the four frames including three frames for lower tone ranges, and connecting means connecting adjacent pairs of the four frames in a manner allowing each adjacent pair to be pivoted relative to each other from a folded state to a flat unfolded state, whereby the four flames are allowed by the connecting means to assume a folded position in which the four frames are folded into a size substantially as large as a size of one frame, and a flat unfolded position in which the four frames are unfolded and extend serially in a direction of the row of the keys, wherein the keys include four white keys arranged on the three frames for the lower tone ranges.

According to this keyboard apparatus, adjacent pairs of four frames having a plurality of keys arranged thereon are connected to each other by connecting means in a manner allowing each adjacent pair to be pivoted relative to each other from a folded state to a flat unfolded state. Therefore, e.g. when the frames are in the flat unfolded position, a keyboard unit arranged on each frame can be overlapped with the frame of a keyboard unit adjacent thereto at a portion connecting the frames, whereas when the frames are in the unfolded position, each keyboard unit can be laminated with the corresponding frame except at the connecting portion. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the four frames are folded into a size substantially as large as a size of one frame, and the flat unfolded position in which the four frames are unfolded and extend serially in a direction of the row of the keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Further, since three of the frames for the lower tone ranges are each configured to have four white keys arranged thereon, this makes it easy not only to make these frames uniform in length in the direction of the row of keys, which facilitates designing the keyboard apparatus in a compact form to thereby enhance portability, but also to carry out multi-model production e.g. using frames identical in construction by varying the number of keys to be arranged on the frame for the highest tone range. Furthermore, the arrangement of "4, 4, 4, . . . " in the number of white keys ensures provision of at least 20 keys in total of white and black keys, so that it is easy to adapt the keyboard apparatus to a wide range of musical scenes. For example, an F key-to-C key arrangement makes it possible to cover a tone range of a large number of tunes, causing little inconvenience in the performance, without excessively limiting the use of the keyboard apparatus. Thus, the present keyboard apparatus has a high durability, portability, and operability, and can be easily adapted to a wide range of musical scenes and multi-model production.

Preferably, the four flames includes one frame for a highest tone range, and the one frame has at two white keys arranged thereon.

According to this preferred embodiment, one of the four frames for the highest tone range has at least two white keys arranged thereon. Therefore, the total of white and black keys of the keyboard apparatus becomes 24 when the one frame for the highest tone range has two keys, and 25, when the one frame has three keys. In both the cases, it is possible to adapt the keyboard apparatus to a wide range of musical scenes. For example, by disposing 24 keys in an F key-to-E key arrangement or a C key-to-B key arrangement, or 25 keys in an F key-to-F key arrangement or a C key-to-C key arrangement, it is possible to cover a tone range for a larger number of tunes, causing little inconvenience in the performance, without excessively limiting the use of the keyboard apparatus. Therefore, by securing at least 24 keys, it is possible to adapt the present keyboard apparatus to an even wider range of musical scenes.

It should be noted that five kinds of black keys are only required to be arranged in the frames in a distributed fashion, and black keys to be positioned between frames are each only required to be arranged on one of adjacent frames, while considering balance of the arrangement of keys.

Preferably, the four flames include one frame for a highest tone range, and the one frame has at least one operating element other than the keys arranged thereon.

According to this preferred embodiment, at least one operating element other than the keys is arranged on the frame for the highest tone range. This makes effective use of limited space of the keyboard apparatus. More specifically, for the one frame for the highest tone range, no keys are provided in the case where the total number of keys arranged on the keyboard apparatus is 20, two white keys are provided in the case where the same is 24, and three white keys are provided in the case where the same is 25. Assuming that the four frames are made uniform in length in the direction of the row of keys, in any of the frames, unused space is produced in the one frame for the highest tone range. However, by arranging at least one operating elements other than the keys, including e.g. ones for effects, in the unused space, it is possible to lay out the operating elements without increasing the whole size of the keyboard apparatus. Therefore, the keyboard apparatus has a high durability and operability, and by ensuring provision of at least 20 keys, the keyboard apparatus can be adapted to a relatively wide range of musical scenes, and through the effective use of unused space, it can be made more compact in size, thereby enhancing portability.

It should be noted that the at least one operating element other than the keys can be a key range shift operating element and the like. Particularly, by arranging the key range shift key at a right-had end of the one frame for the highest tone range, it becomes easy to perform operation for shifting the key range.

It should be noted that it is possible to cause the keyboard apparatus to assume the folded position and the flat unfolded position by moving keyboard units at laterally opposite ends of the keyboard apparatus to shift relative to the frames associated therewith in the direction of the row of keys. In this case, it is preferred that when the keyboard units at the laterally opposite ends are shifted toward the center of the keyboard apparatus (rightward in the case of a left-hand end keyboard unit, and leftward in the case of a righthand end keyboard unit), adjacent frames are inhibited from being pivoted relative to each other, and that when the same keyboard units are shifted away from each other in respective lateral directions, the adjacent frames are allowed to be pivoted relative to each other. This makes it possible to fold the keyboard apparatus by a simple and easy operation, and fixes the frames in the flat folded position when in use, which improves operability.

To attain the second object, according to a second aspect of the present invention, there is provided a keyboard apparatus comprising a plurality of keys arranged in a row, the keys comprising white keys and black keys, a plurality of frames each having a plurality of the white keys and a plurality of the black keys arranged thereon, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, wherein the black keys arranged on each of the frames have a thickness of not larger than 5 mm, the black keys being formed such that substantially all surface areas thereof visible from right above are located substantially on a plane.

According to this keyboard apparatus, adjacent pairs of a plurality of frames having a plurality of white keys and a plurality of black keys arranged thereon are connected to each other by connecting means in a manner allowing each adjacent pair to be pivoted relative to each other from a folded state to a flat unfolded state. Therefore, e.g. when the frames are in the flat unfolded position, a keyboard unit arranged on each frame can be overlapped with the frame of a keyboard unit adjacent thereto at a portion connecting the frames, whereas when the frames are in the unfolded position, each keyboard unit can be laminated with the corresponding frame except at the connecting portion. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, the black keys arranged on each of the frames have a thickness of not larger than 5 mm, and are formed such that substantially all surface areas thereof visible from right above are located substantially on a plane. This makes it possible to minimize the thickness of black keys, and reduce the vertical dimension of the keyboard apparatus. Therefore, the keyboard apparatus can be minimized in thickness to enhance portability thereof while maintaining a high durability and operability.

To attain the third object, according to a third aspect of the present invention, there is provided a keyboard apparatus comprising a plurality of keys arranged in a row, the keys comprising white keys and black keys, a plurality of frames, connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, and a plurality of keyboard units arranged on the frames, respectively, each of the keyboard units having a white key unit and a black key unit, the white key unit having a plurality of the white keys having a common key base portion, and the black key unit having a plurality of the black keys having a common key base portion, the white key unit and the black key unit being laminated upon each other via the common key base portions of the white keys and the black keys, wherein the white keys of the white key unit and the black keys of the black key unit have a thickness of not larger than 5 mm, the black white keys and the black keys being formed such that substantially all surface areas thereof visible from right above are located substantially on a plane.

According to this keyboard apparatus, adjacent pairs of a plurality of frames are connected to each other by connecting means in a manner allowing each adjacent pair to be pivoted relative to each other from a folded state to a flat unfolded state. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, on the frames, there are arranged a plurality of keyboard units, respectively, each having a white key unit and a black key unit, the white key unit having a plurality of the white keys having a common key base portion and the black key unit having a plurality of the black keys having a common key base portion, and the white key unit and the black key unit are laminated upon each other via the common key base portions of the white keys and the black keys. This makes it possible to assemble each keyboard unit only by laminating an associated pair of white and black key units, thereby facilitating assemblage of the keyboard apparatus. Further, the white keys and the black keys arranged on each of the frames have a thickness of not larger than 5 mm, and are formed such that substantially all surface areas thereof visible from right above are located substantially on a plane. This makes it possible to minimize the thickness of white keys and black keys, and reduce the vertical dimension of the keyboard apparatus. Thus, manufacture of the keyboard apparatus can be made easy by facilitating assembly work of each keyboard unit, while maintaining a high durability, portability, and operability of the keyboard apparatus.

To attain the above third object, according to a fourth aspect of the invention, there is provided a keyboard apparatus comprising a plurality of keys arranged in a row, the keys comprising white keys and black keys, a plurality of frames, connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, and a plurality of keyboard units arranged on the frames, respectively, each of the keyboard units having a white key unit and a black key unit, the white key unit having a plurality of the white keys having a common key base portion, and the black key unit having a plurality of the black keys having a common key base portion, the white key unit and the black key unit being laminated upon each other via the common key base portions of the white keys and the black keys, wherein at least one of the white key unit and the black key unit is shaped in a flat plate form.

According to this keyboard apparatus, adjacent pairs of a plurality of frames are connected to each other by connecting means in a manner allowing each adjacent pair to be pivoted relative to each other from a folded state to a flat unfolded state. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, on the frames, there are arranged a plurality of keyboard units, respectively, each having a white key unit and a black key unit, the white key unit having a plurality of the white keys having a common key base portion and the black key unit having a plurality of the black keys having a common key base portion, and the white key unit and the black key unit are laminated upon each other via the common key base portions of the white keys and the black keys. This makes it possible to assemble each keyboard unit only by laminating an associated pair of white and black key units, thereby facilitating assemblage of the keyboard apparatus. Further, since at least one of the white key unit and the black key unit is shaped in a flat plate form, it is possible not only to reduce the thickness of white and/or black keys to thereby reduce the vertical dimension of the keyboard apparatus, but also to manufacture the keyboard units by blanking a flat plate or the like to thereby simplify the configuration and manufacturing of the keyboard apparatus. This makes it possible to facilitate manufacture of the keyboard apparatus by simplifying the configuration and assembly thereof while maintaining a high durability, portability, and operability of the keyboard apparatus.

It should be noted that by configuring key-operating portions (frontward of a hinge) of white keys and black keys such that they have the same thickness as the key base end portions, it becomes easy to make a keyboard unit which is in the form of comb teeth by blanking a flat plate.

Further, it is preferred that both of the white key unit and the black key unit are shaped in a flat plate form, and the key base portion of the black key unit is laminated on the key base portion of the white key unit.

According to this preferred embodiment, since both of the white key unit and the black key unit are shaped in a flat plate form, and the key base portion of the black key unit is laminated on the key base portion of the white key unit, it is possible not only to reduce the thickness of white and black keys to thereby further reduce the vertical dimension of the keyboard apparatus, but also to manufacture the keyboard units by blanking a flat plate or the like to thereby simplify the configuration and manufacturing of the keyboard apparatus. Further, the only work of laminating each of the key base portion of the black key unit on the corresponding one of the key base unit of the while key unit automatically produces a difference in height between the white keys and the black keys by the thickness of the black key units, whereby the black keys can protrude above the white keys as in the ordinary keyboard. This causes the black keys to present a feature characteristic of the black key, thereby allowing the user to perform blind operation. Thus, it is possible to enhance operability of the keyboard apparatus by enabling blind operation of keys, through the simple configuration and easy assembly work.

It should be noted that the white key units and the black key units may be formed to have the same thickness.

To attain the fourth object, according to a fifth aspect of the invention, there is provided a keyboard apparatus comprising a plurality of keys arranged in a row, the keys comprising white keys and black keys, a plurality of frames each having a plurality of the white keys and a plurality of the black keys arranged thereon, the frames including a frame for a lowest tone range having a left-hand end and a frame for a highest tone range having a right-hand end, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, and at least one key range shift operating element arranged in a vicinity of at least one of the left-hand end of the frame for the lowest tone range and the right-hand end of the frame for the highest tone range, for changing pitch of a tone generated by key depression.

According to this keyboard apparatus, adjacent pairs of a plurality of frames having a plurality of white keys and a plurality of black keys arranged thereon are connected to each other by connecting means in a manner allowing each adjacent pair to be pivoted relative to each other from a folded state to a flat unfolded state. Therefore, e.g. when the frames are in the flat unfolded position, a keyboard unit arranged on each frame can be overlapped with the frame of a keyboard unit adjacent thereto at a portion connecting the frames, whereas when the frames are in the unfolded position, each keyboard unit can be laminated with the corresponding frame except at the connecting portion. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, since at least one key range shift operating element for changing pitch of a tone generated by key depression is provided, the tone range which can be sounded is widened, and what is more, the at least one key range shift operating element is arranged in a vicinity of at least one of the left-hand end of the frame for the lowest tone range and the right-hand end of the frame for the highest tone range, it is easy to operate the at least one key range shift operating element. Therefore, the keyboard apparatus has a high durability, portability, and operability, and is capable of covering a wide tone range with a reduced number of keys and easy key range-shifting operation.

To attain the above object, according to a sixth aspect of the present invention, there is provided a keyboard apparatus comprising a plurality of keys arranged in a row, at least one key range shift operating element for changing pitch of a tone generated by key depression, a plurality of frames including a left-hand end frame and a right-hand end frame, a plurality of keyboard units arranged on the frames, respectively and having the plurality of keys, the keyboard units including a left-hand end keyboard unit and a right-hand end keyboard unit associated with the left-hand end frame and the right-hand end frame, respectively, connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, by moving the left-hand end keyboard unit and the right-hand end keyboard unit relative to the left-hand end frame and the right-hand end frames, respectively, in the direction of the row of the keys, and two grips arranged on the left-hand end keyboard unit and the right-hand end keyboard unit, respectively, for moving the left-hand end keyboard unit and the right-hand end keyboard unit, in the direction of the row of the keys, wherein the at least one key range shift operating element also serves as at least one of the two grips.

According to this keyboard apparatus, adjacent pairs of a plurality of frames are connected to each other by connecting means in a manner allowing each adjacent pair to be pivoted relative to each other from a folded state to a flat unfolded state. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys, by moving keyboard units at laterally opposite ends of the keyboard apparatus to shift relative to the frames associated therewith in the direction of the row of keys. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, since at least one key range shift operating element for changing pitch of a tone generated by key depression is provided, the tone range which can be sounded is widened. What is more, two grips are arranged on the left-hand end keyboard unit and the right-hand end keyboard unit, respectively, for moving the left-hand end keyboard unit and the right-hand end keyboard unit, in the direction of the row of the keys, and the at least one key range shift operating element are configured to also serves as at least one of the two grips. Therefore, the configuration of the keyboard apparatus can be made simpler than when the key range shift operating elements and the grips are separately provided. Therefore, the keyboard apparatus has a high durability, portability, and operability, and is capable of covering a wide tone range by the simple configuration and with a reduced number of keys.

To attain the fifth object, according to a seventh aspect of the invention, there is provided a keyboard apparatus comprising a plurality of keys arranged in a row, a plurality of frames including a left-hand end frame and a right-hand end frame, a plurality of keyboard units arranged on the frames, respectively and having the plurality of keys, the keyboard units including a left-hand end keyboard unit and a right-hand end keyboard unit associated with the left-hand end frame and the right-hand end frame, respectively, musical tone-generating means for generating a musical tone signal in accordance with operation of each key on the keyboard units, connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, by moving the left-hand end keyboard unit and the right-hand end keyboard unit relative to the left-hand end frame and the right-hand end frames, respectively, in the direction of the row of the keys, and two acoustic conversion devices arranged on the left-hand end frame and the right-hand end frame at locations rearward of the left-hand end keyboard unit and the right-hand end keyboard unit, for converting a musical tone signal generated by the musical tone-generating means into sound.

According to this keyboard apparatus, adjacent pairs of a plurality of frames having a plurality of keys arranged thereon are connected to each other by connecting means in a manner allowing each adjacent pair to be pivoted relative to each other from a folded state to a flat unfolded state. Therefore, e.g. when the frames are in the flat unfolded position, a keyboard unit arranged on each frame can be overlapped with the frame of a keyboard unit adjacent thereto at a portion connecting the frames, whereas when the frames are in the unfolded position, each keyboard unit can be laminated with the corresponding frame except at the connecting portion. This mechanism of folding the keyboard apparatus improves the rigidity and durability of the keyboard apparatus irrespective of whether the frames assume either of the two positions, compared with the bending of a sheet-shaped keyboard into a folded state. Further, the frames are configured to assume the folded position in which the plurality of frames are folded into a size substantially as large as a size of one frame, and the flat unfolded position in which the plurality of frames are unfolded and extend serially in a direction of the row of the keys, by moving the keyboard units at laterally opposite ends of the keyboard unit are moved in the direction of the row of keys relative to each other. This makes it possible to make the keyboard apparatus compact in size when the frames are in the folded position and carry the same with the frames in the folded position, and play the same with the frames in the flat unfolded position. Furthermore, the keys are arranged not on a soft sheet but on a frame having a certain degree of hardness, which makes it easy to perform key-depressing operation. Moreover, a musical tone signal is generated by musical tone-generating means in accordance with operation of each key on the keyboard units, and the musical tone signal generated by the musical tone-generating means is converted into sound by two acoustic conversion devices. This makes it possible to generate sound in response to key depression. What is more, the two acoustic conversion devices are arranged on the left-hand end frame and the right-hand end frame at locations rearward of the left-hand end keyboard unit and the right-hand end keyboard unit. This arrangement prevents the two acoustic conversion devices from interfering with the left-hand end frame and the right-hand end frame when the frames are moved in the direction of the row of keys when the frames are switched between the folded position and the flat unfolded position. Therefore, the acoustic conversion devices can be arranged without wastefully using the limited space, which contributes to making the keyboard apparatus compact in size, thereby maintaining portability of the same. This enables the keyboard apparatus to generate sound in response to key depression while maintaining a high durability, portability, and operability.

Preferably, the two acoustic conversion devices are positioned at a left-hand end of the left-hand end frame and a right-hand end of the right-hand end frame, respectively, when the frames assume the unfolded position.

According to this preferred embodiment, the two acoustic conversion devices are at a left-hand end of the left-hand end frame and a right-hand end of the right-hand end frame, respectively, when the frames assume the unfolded position. Therefore, the two acoustic conversion devices are arranged at locations enabling a stereophonic sound to be most effectively generated, whereby excellent stereophonic effects can be obtained.

To attain the sixth object, according to an eighth aspect of the invention, there is provided a keyboard apparatus comprising a plurality of elongated keys arranged in a row, the keys comprising white keys and black keys of a type for a musical keyboard, a plurality of frames, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, wherein the keys are positioned above the connecting means when the flames are in the flat unfolded position.

To attain the sixth object, according to a ninth aspect of the invention, there is provided a keyboard apparatus comprising a plurality of elongated keys arranged in a row, the keys comprising white keys and black keys of a type for a musical keyboard, four frames each having part of the keys arranged thereon, the four frames including three frames for lower tone ranges, and connecting means connecting adjacent pairs of the four frames in a manner allowing each adjacent pair to be pivoted relative to each other from a folded state to a flat unfolded state, whereby the four flames are allowed by the connecting means to assume a folded position in which the four frames are folded into a size substantially as large as a size of one frame, and a flat unfolded position in which the four frames are unfolded and extend serially in a direction of the row of the keys, wherein the keys are positioned above the connecting means when the flames are in the flat unfolded position.

To attain the sixth object, according to a tenth aspect of the invention, there is provided a keyboard apparatus comprising a plurality of elongated keys arranged in a row, the keys comprising white keys and black keys of a type for a musical keyboard, a plurality of frames each having a plurality of the white keys and a plurality of the black keys arranged thereon, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, wherein the keys are positioned above the connecting means when the flames are in the flat unfolded position.

To attain the sixth object, according to an eleventh aspect of the invention, there is provided a keyboard apparatus comprising a plurality of elongated keys arranged in a row, the keys comprising white keys and black keys of a type for a musical keyboard, a plurality of frames, connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, and a plurality of keyboard units arranged on the frames, respectively, each of the keyboard units having a white key unit and a black key unit, the white key unit having a plurality of the white keys having a common key base portion, and the black key unit having a plurality of the black keys having a common key base portion, the white key unit and the black key unit being laminated upon each other via the common key base portions of the white keys and the black keys, wherein the keys are positioned above the connecting means when the flames are in the flat unfolded position.

To attain the sixth object, according to a twelfth aspect of the invention, there is provided a keyboard apparatus comprising a plurality of elongated keys arranged in a row, the keys comprising white keys and black keys of a type for a musical keyboard, at least one key range shift operating element for changing pitch of a tone generated by key depression, a plurality of frames including a left-hand end frame and a right-hand end frame, a plurality of keyboard units arranged on the frames, respectively and having the plurality of keys, the keyboard units including a left-hand end keyboard unit and a right-hand end keyboard unit associated with the left-hand end frame and the right-hand end frame, respectively, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, by moving the left-hand end keyboard unit and the right-hand end keyboard unit relative to the left-hand end frame and the right-hand end frames, respectively, in the direction of the row of the keys, wherein the keys are positioned above the connecting means when the flames are in the flat unfolded position.

To attain the sixth object, according to a thirteenth aspect of the invention, there is provided a keyboard apparatus comprising a plurality of elongated keys arranged in a row, the keys comprising white keys and black keys of a type for a musical keyboard, a plurality of frames including a left-hand end frame and a right-hand end frame, a plurality of keyboard units arranged on the frames, respectively and having the plurality of keys, the keyboard units including a left-hand end keyboard unit and a right-hand end keyboard unit associated with the left-hand end frame and the right-hand end frame, respectively, musical tone-generating means for generating a musical tone signal in accordance with operation of each key on the keyboard units, and connecting means connecting adjacent pairs of the frames in a manner allowing each adjacent pair to be pivoted relative to each other from a folded state to a flat unfolded state, whereby the flames are allowed by the connecting means to assume a folded position in which the frames are folded into a size substantially as large as a size of one frame, and a flat unfolded position in which the frames are unfolded and extend serially in a direction of the row of the keys, by moving the left-hand end keyboard unit and the right-hand end keyboard unit relative to the left-hand end frame and the right-hand end frames, respectively, in the direction of the row of the keys, wherein the keys are positioned above the connecting means when the flames are in the flat unfolded position.

The above and other objects, features and advantages of the invention will become more apparent from the following detailed description taken in conjunction with the accompanying drawings.

DETAILED DESCRIPTION OF THE PREFERRED EMBODIMENTS

Now, the present invention will be described in detail with reference to the drawings showing embodiments of the present invention.

(First Embodiment)

Figure 1:
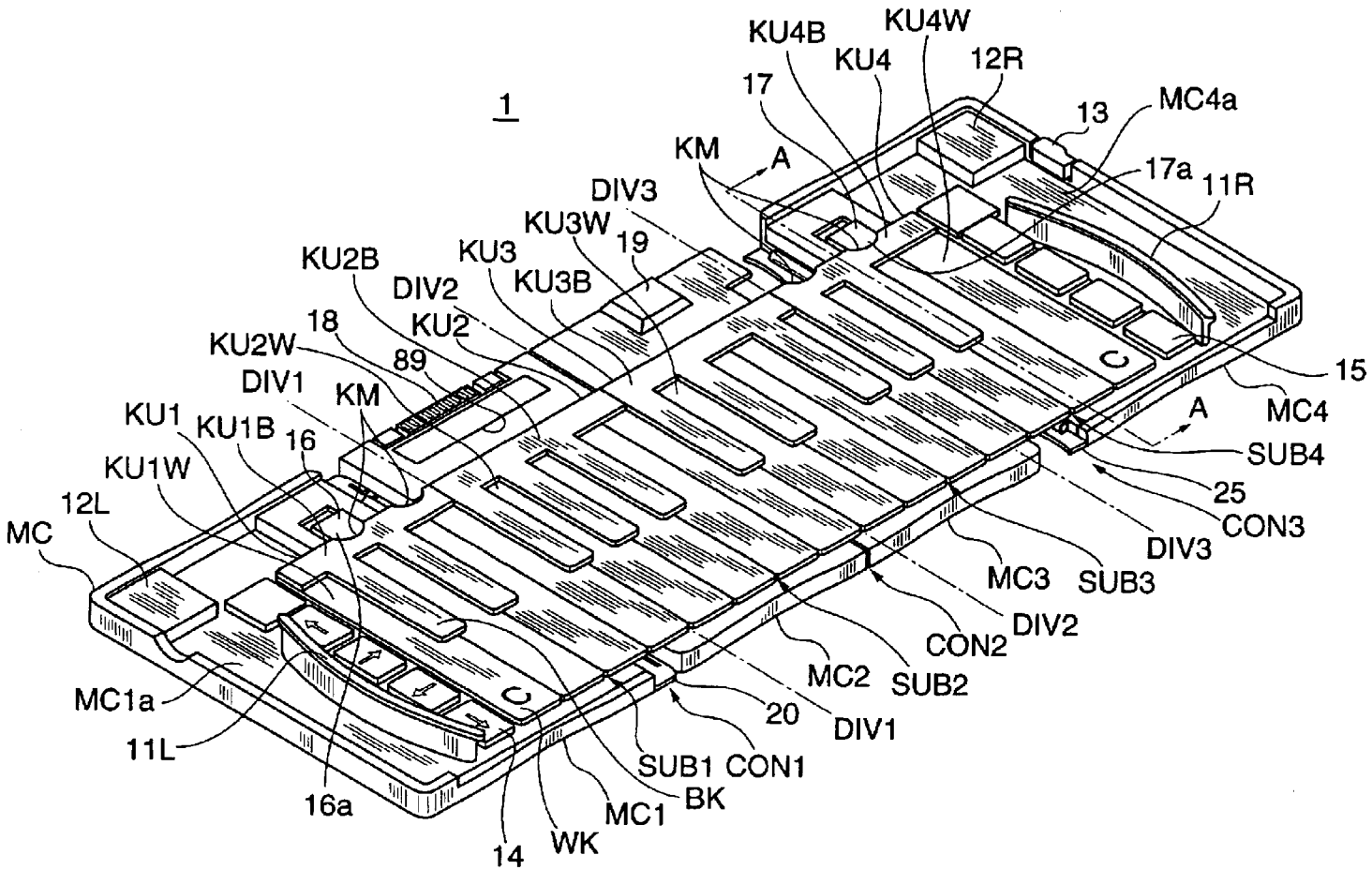
FIG. 1 is a perspective view showing the appearance of a keyboard apparatus according to a first embodiment of the present invention.

FIG. 1 is a perspective view showing the appearance of a keyboard apparatus according to a first embodiment of the present invention.

The keyboard apparatus 1 is of a small-sized type which can be folded to carry, and unfolded to play or connect to a mobile computer so as to input and edit musical tone data. FIG. 1 shows the apparatus 1 in an unfolded state. In the following, the side of the apparatus 1 toward the player will be referred to as "the front side".

The present keyboard apparatus 1 includes a main case MC as a frame formed of a synthetic resin, which is divided into four blocks arranged in series from the lowest tone range side in the order of a first main case MC1, a second main case MC2, a third main case MC3, and a fourth main case MC4. Arranged on the first to fourth main cases MC1 to MC4 are respective sub-frame assemblies SUB1 to SUB4, described in detail hereinafter with reference to FIG. 7, and on these sub-frame assemblies, there are arranged keyboard units KU1 to KU4, respectively. One dot-chain lines designated by DIV1, DIV2, and DIV3 indicate respective borders dividing between each pair of sub-frame assemblies SUB1 and SUB2, sub-frame assemblies SUB2 and SUB3, and sub-frame assemblies SUB3 and SUB4.

As described in detail hereinafter, the first and second main cases MC1 and MC2, the second and third main cases MC2 and MC3, and the third and fourth main cases MC4 are pivotally connected by connecting portions CON1, CON2, and CON3, respectively. Further, the sub-frame assemblies SUB1 and SUB4 are arranged on the first and fourth main cases MC1 and MC4, respectively, such that they can be slid along a row of the keys (in a lateral direction), and they are moved or slid when the keyboard apparatus 1 is folded or unfolded.

Figure 2:
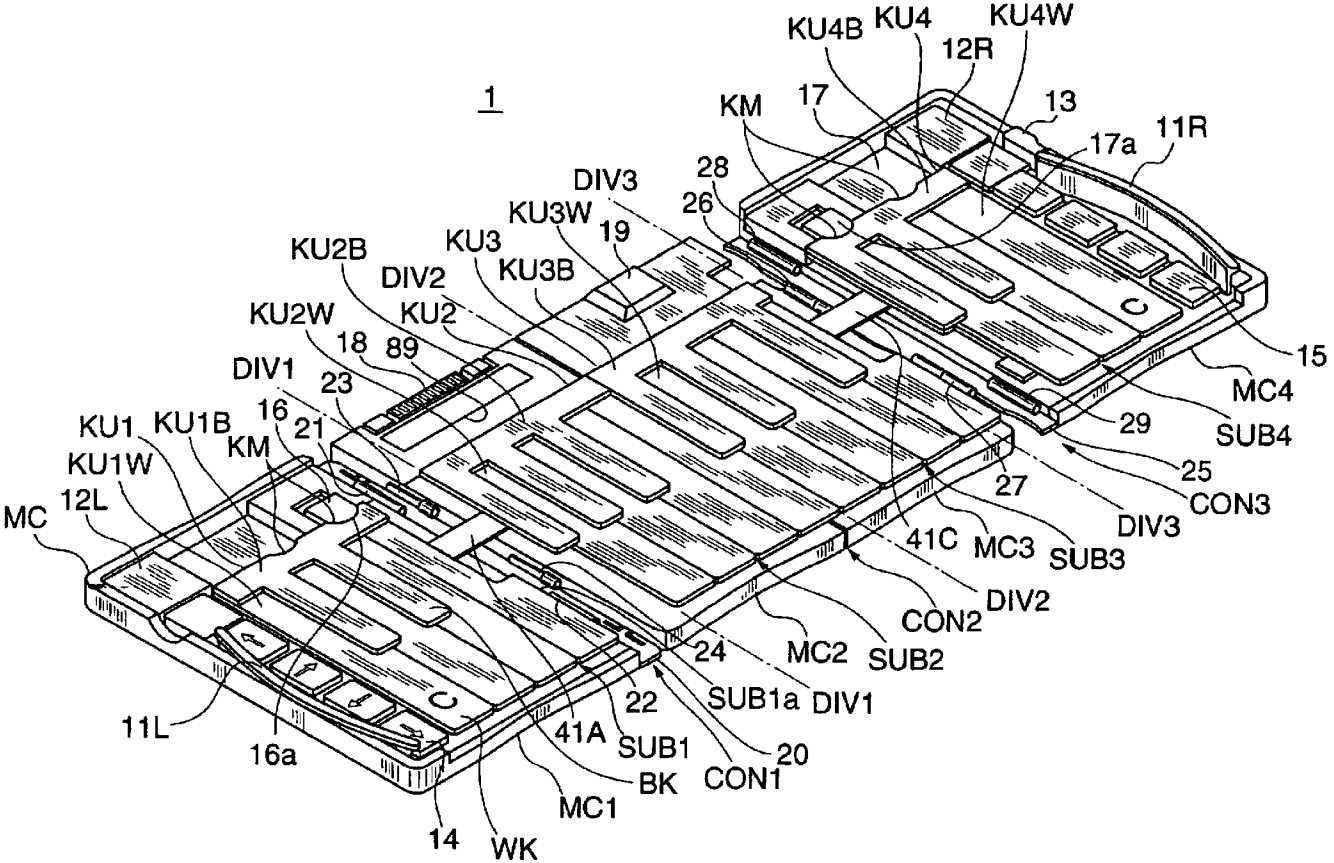
FIG. 2 is a perspective view showing a state of the keyboard apparatus of FIG. 1 in which sub-frame assemblies SUB1, SUB4 are moved to respective left-hand and right-hand end positions.
Figure 3:
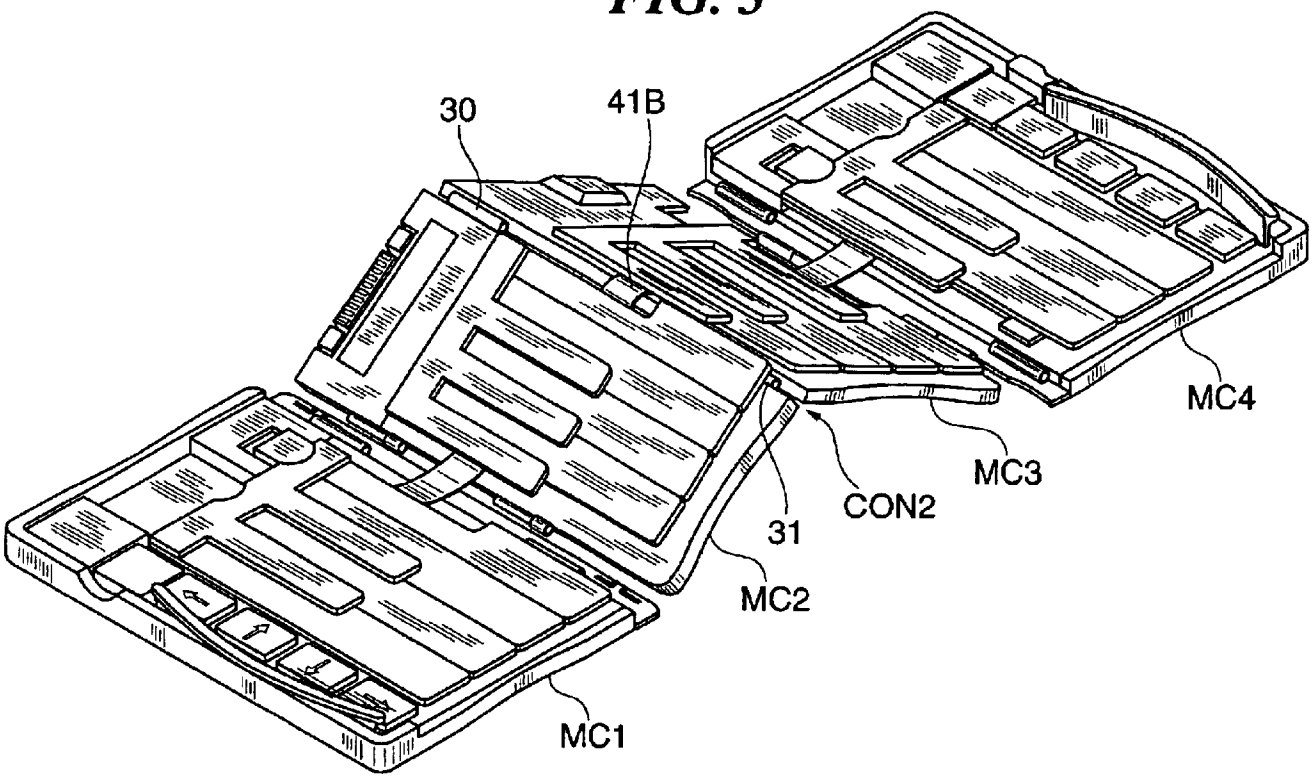
FIG. 3 is a perspective view showing a state of the keyboard apparatus in which a second main case and a third main case are being pivoted about a connecting portion connecting them so as to cause them to be overlaid with each other.
Figure 4:
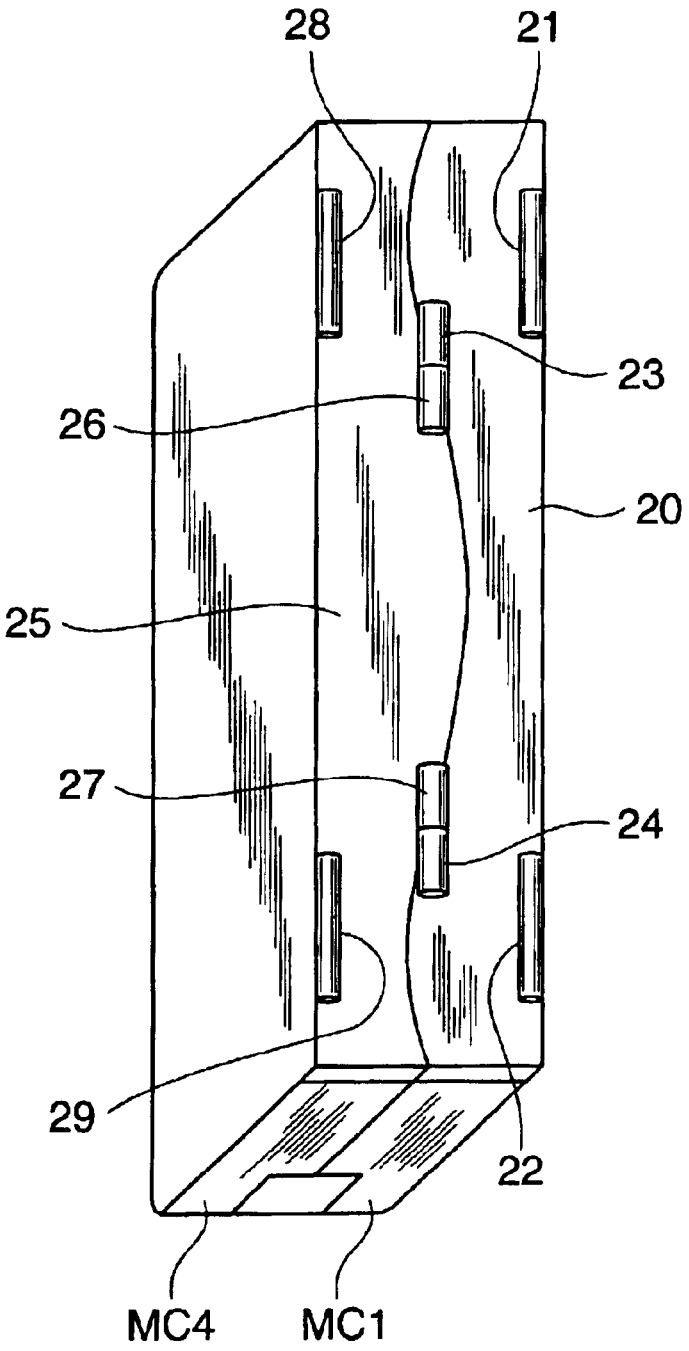
FIG. 4 is a view of the keyboard apparatus in which four main cases are folded and overlaid with each other.
Figure 5:
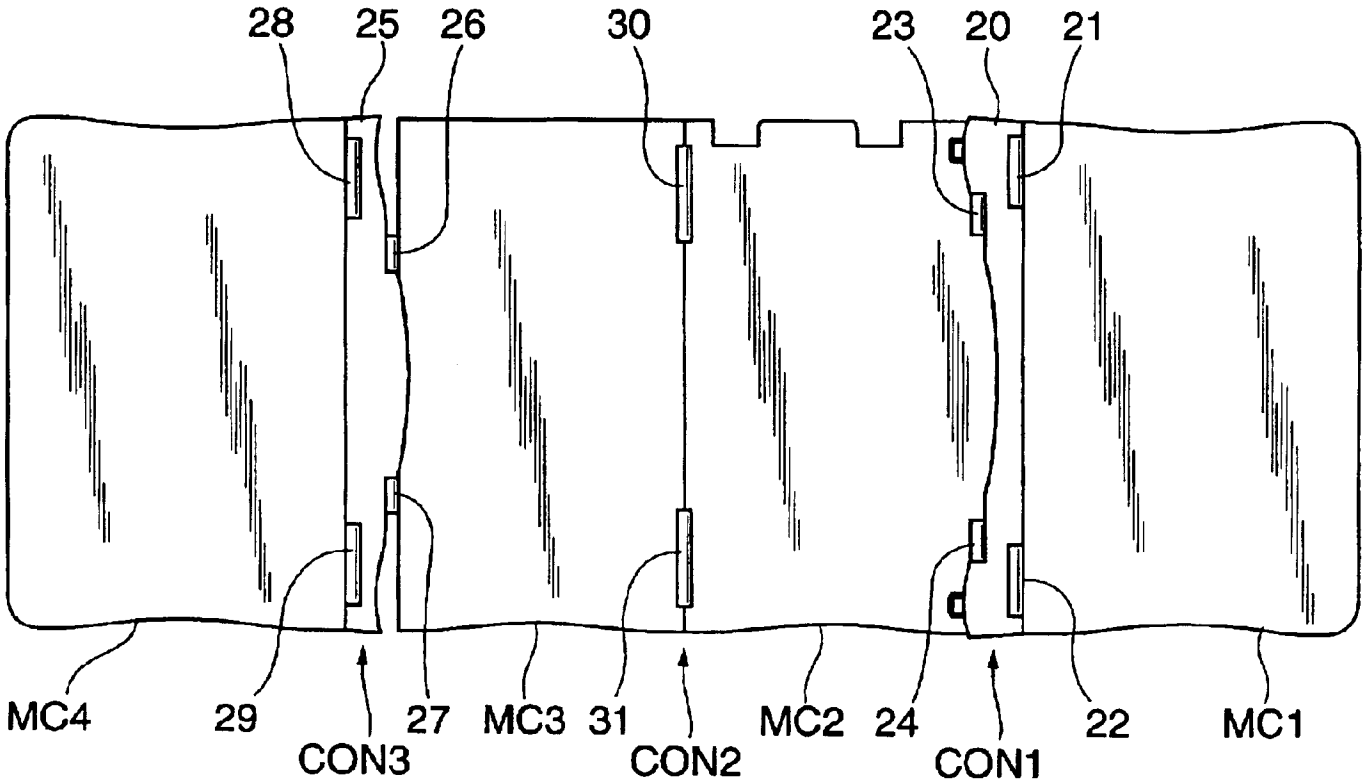
FIG. 5 is a bottom view of the keyboard apparatus in an unfolded state.

FIGS. 2 to 4 are views of the appearance of the keyboard apparatus 1 illustrating a folding process from the unfolded state to the folded state. FIG. 2 shows a state of the keyboard apparatus 1 in which the sub-frame assemblies SUB1 and SUB4 are moved to a left-hand end position and a right-hand end position, respectively. FIG. 3 shows a state of the keyboard apparatus 1 in which the second and third main cases MC2 and MC3 are being pivoted about the connecting portion CON2 so as to cause them to be overlaid with each other. FIG. 4 shows a state of the keyboard apparatus 1 in which the four main cases MC1 to MC4 are folded and overlaid with each other. FIG. 5 is a bottom view of the keyboard apparatus 1 in the unfolded state.

When the keyboard apparatus 1 is in the folded state shown in FIGS. 1 and 5, i.e. when the four main cases MC1 to MC4 are in a flat-unfolded position in which they are unfolded and extend in series in the direction of the row of keys, it is possible to play the keyboard apparatus 1. On the other hand, the keyboard apparatus 1 is normally carried in the folded state shown in FIG. 4, i.e. when the four main cases MC1 to MC4 are in a folded position in which they are folded into a substantially the same size as one main case.

Now, the unfolding and folding mechanism of the present device 1 will be described.

As shown in FIGS. 2 and 5, the connecting portion CON1 is comprised of a connecting piece 20 and hinges 21, 22, 23, 24. The two 21, 22 of the hinges enable the first main case MC1 and the connecting piece 20 to pivot relative to each other, while the remaining two 23, 24 enable the connecting piece 20 and the second main case MC2 to pivot relative to each other. Similarly, the connecting portion CON3 is comprised of a connecting piece 25 and hinges 26, 27, 28, 29. The two 26, 27 of the hinges enable the second main case MC3 and the connecting piece 25 to pivot relative to each other, while the remaining two 28, 29 enable the connecting piece 25 and the fourth main case MC4 to pivot relative to each other.

When the sub-frame assembly SUB1 is moved to the left-hand end position shown in FIG. 2, the main cases MC1 and MC2 can be freely pivoted, whereas when the same is moved to the right-hand end position, i.e. to the position shown in FIG. 1, a right end portion SUB1a of the sub-frame assembly SUB1 overlaps the main case MC2, and hence the pivoting motions are inhibited. This relationship also applies to the relationship between the main cases MC3 and MC4, that is, when the sub-frame assembly SUB4 is moved to the right-hand end position shown in FIG. 2, the main cases MC3 and MC4 can be pivoted, whereas when the same is moved to the left-hand end position shown in FIG. 1, the pivoting motions are inhibited. This fixes the main cases MC1 to MC4 in the flat-unfolded position when the keyboard apparatus 1 is used, which enhances the operability of the device 1.

As shown in FIGS. 3 and 5, the connecting portion CON2 is comprised of hinges 30, 31. These hinges 30, 31 enable the main cases MC2 and MC3 to pivot in a direction of reducing an angle formed between respective underside surfaces thereof, but inhibits them from pivoting from the unfolded state in a direction of reducing an angle formed between respective front surfaces thereof.

By virtue of the functions of these connecting portions CON1 to CON3, when the keyboard apparatus 1 is folded, the four main cases are overlaid with each other such that the respective bottom sides of the main cases MC2, MC3 face each other, the respective top sides of the main cases MC1, MC2 are faced with each other, and the respective top sides of the main cases MC3, MC4 are faced each other. This reduces the size of the present device 1 to a size substantially as large as the size of one main case.

Figure 6:
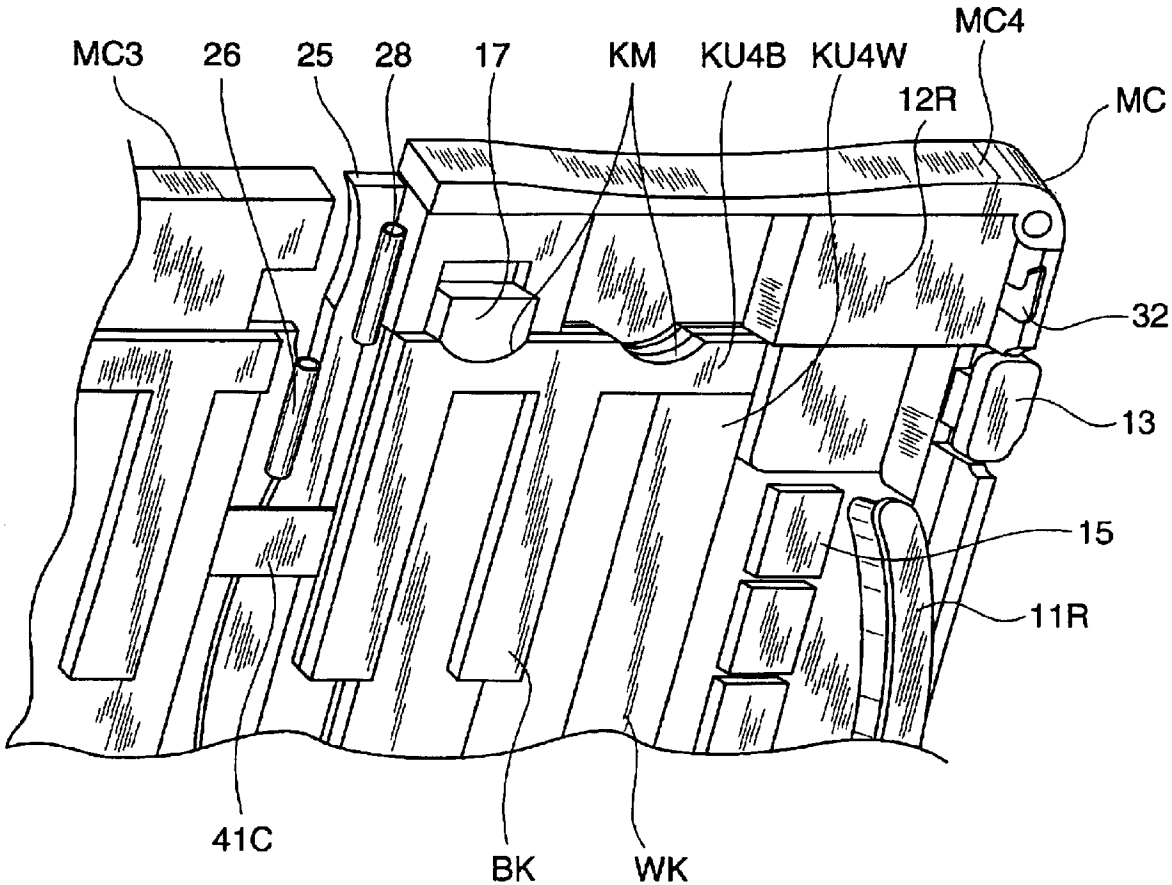
FIG. 6 is a fragmentary perspective view showing part of the keyboard apparatus in the unfolded state.

FIG. 6 is a fragmentary perspective view of the keyboard apparatus 1 in the unfolded state.

As shown in FIG. 6, the main case MC4 is provided with a lever 13 and a nail 32. The main case MC1 is provided with an engaging potion, not shown, for engagement with the nail 32, whereby when the keyboard apparatus 1 is folded, the nail 32 and the engaging portion are engaged to maintain the folded state of the keyboard apparatus 1. Further, the nail 32 can be moved frontward by sliding the lever 13 frontward (toward the player), and to unfold the keyboard apparatus 1 from the folded state, the nail 32 and the engaging portion 32 can be disengaged from each other by moving the lever 13 frontward.

Also arranged on the main cases MC are, as shown in FIG. 1, left and right loudspeakers 12L, 12R, engaging pieces 16, 17 having respective front portions 16*a*, 17*a* shaped in arcuate form, a display 89 implemented e.g. by an LCD, an I/F (interface) 18 for connection to a mobile computer 60, referred to hereinafter, as well as an accommodating section 19 that accommodates a storage device 84, a tone generator circuit 87, a power supply section 88, all referred to hereinafter, and so forth.

The speaker 12L is arranged at a left end portion MC1*a* of the main case MC1 and rearward of the keyboard unit KU1. The speaker 12R is arranged at a right end portion MC4*a* of the main case MC4 and rearward of the keyboard unit KU4. This arrangement prevents the speakers 12L, 12R from interfering with the sub-frame assemblies SUB1, SUB4 when the sub-frame assemblies SUB1, SUB4 are slid along the row of keys relative to the first and second main cases MC1, MC4, respectively. Thus the limited space is effectively made use of, whereby the provision of the speakers is prevented from presenting a hindrance to making the keyboard apparatus 1 compact in size. Further, the speakers 12L, 12R are arranged at the respective left and right ends of the keyboard apparatus which are positioned most outward when the keyboard apparatus 1 is unfolded, which enables a stereophonic sound to be effectively generated.

The keyboard unit KU1 arranged on the sub-frame assembly SUB1 includes a white key unit KU1W, and a black key unit KU1B as well as a key range shift operating element 11L for changing the pitch of a tone to be generated by depression of each key. As described hereinafter, depression of the key range shift operating element 11L causes the tone range to be set one octave lower (or recover the original state). Also arranged on the keyboard unit KU1 are a group of operating elements 14 for carrying out various operations on a display screen of the mobile computer 6 connected to the keyboard apparatus 1.

It should be noted that part of the group of operating elements 14 and/or part of a group of operating elements 15, referred to hereinafter, on the keyboard unit 11 may be assigned to the key range shift operating element 11.

The keyboard unit KU2 arranged on the sub-frame assembly SUB2 is comprised of a white key unit KU2W, and a black key unit KU2B, and the keyboard unit KU3 arranged on the sub-frame assembly SUB3 is comprised of a white key unit KU3W, and a black key unit KU3B.

The keyboard unit KU4 arranged on the sub-frame assembly SUB4 is comprised of a white key unit KU4W, a black key unit KU4B, and a key range shift operating element 11R for shifting the pitch of a tone to be generated by depression of each key. As described hereinafter, depression of the key range shift operating element 11R causes the key range to be set one octave higher (or recover the original state). Also arranged on the keyboard unit KU4 are the group of operating elements 15 for switching modes, setting tone colors, and setting various effects to be imparted to musical tones.

Further, as shown in FIGS. 1, 2, and 6, the keyboard units KU1, KU4 are each provided with two engaging recesses KM. The engaging recesses KM each have a concave shape to which the arcuate shape of a corresponding one of the front portions 16*a*, 17*a* of the engaging pieces 16, 17 can be fitted. The engaging pieces 16, 17 are each always urged frontward by a resilient member, such as a spring, and when the sub-frame assemblies SUB1, SUB4 are in respective positions shown in FIG. 1, the engaging pieces 16, 17 are fitted in the outer (lateral end-side) ones of the engaging recesses KM. When the sub-frame assemblies SUB1, SUB4 are slid leftward and rightward along the row of keys from the state shown in FIG. 1, respectively, the engaging pieces 16, 17 are withdrawn rearward, and when the assemblies SUB1, Sub4 are further slid, the engaging pieces 16, 17 are fitted in the inner ones of the engaging recesses KM, as shown in FIG. 2. Therefore, by causing the engaging pieces 16, 17 to be selectively engaged with the engaging recesses KM, two stable positions of each of the sub-frame key assemblies SUB1, SUB4 in the direction of the row of keys (positions shown in FIGS. 1 and 2) can be defined.

Next, the internal constructions of the sub-frame assemblies SUB1 to SUB4 and the keyboard units KU1 to KU4 will be described.

Figure 7:
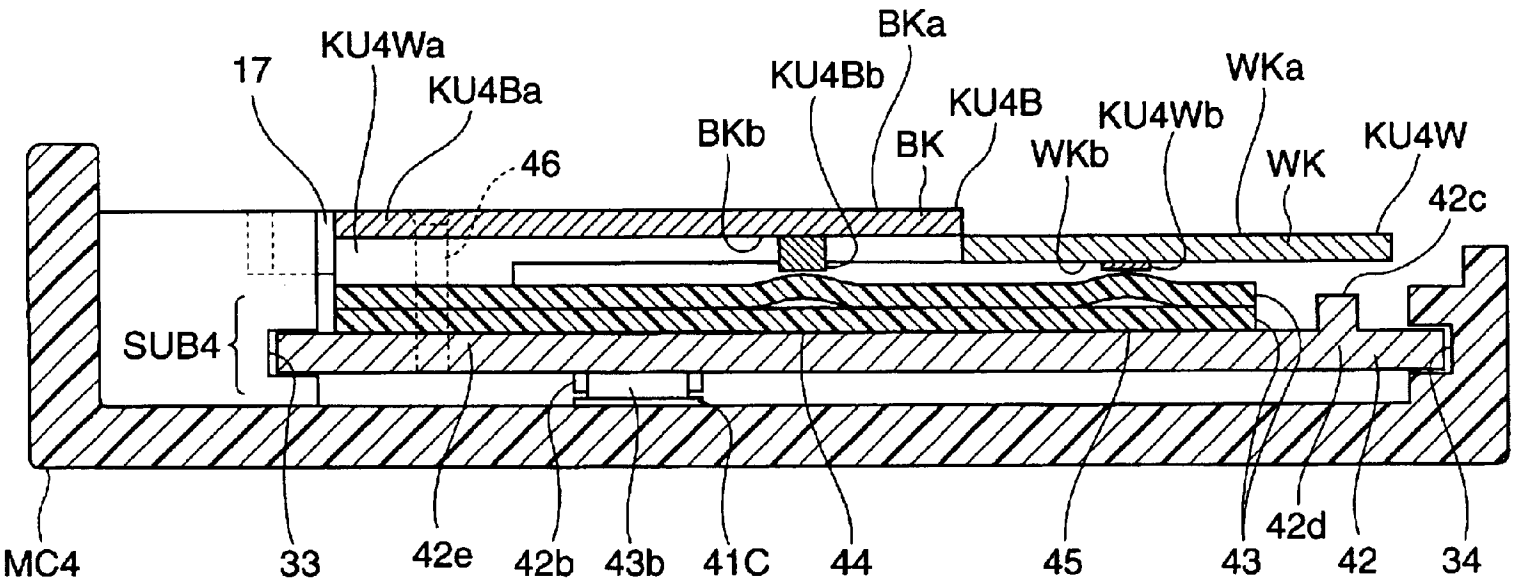
FIG. 7 is a cross-sectional view taken on line A—A in FIG. 1.
Figure 8:
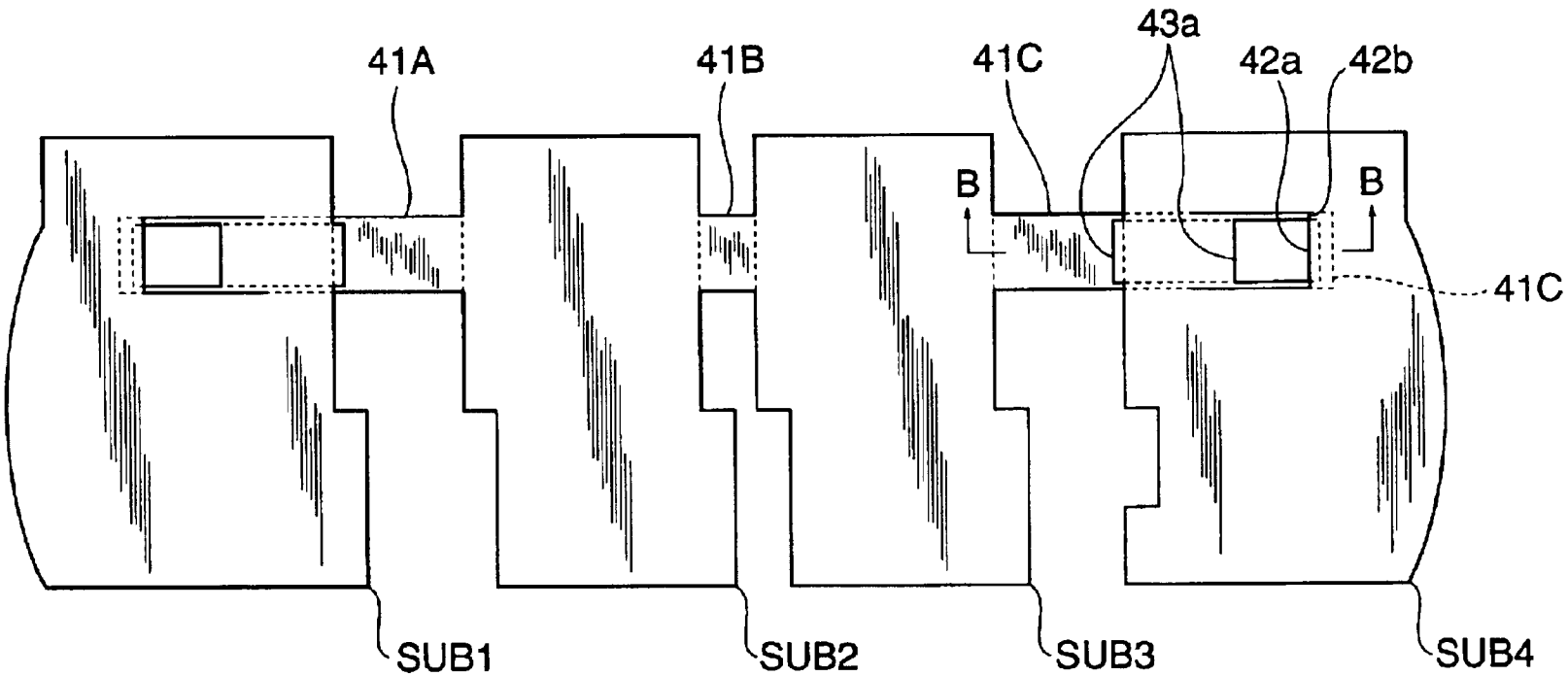
FIG. 8 is a plan view of a sub-frame assembly.
Figure 9:
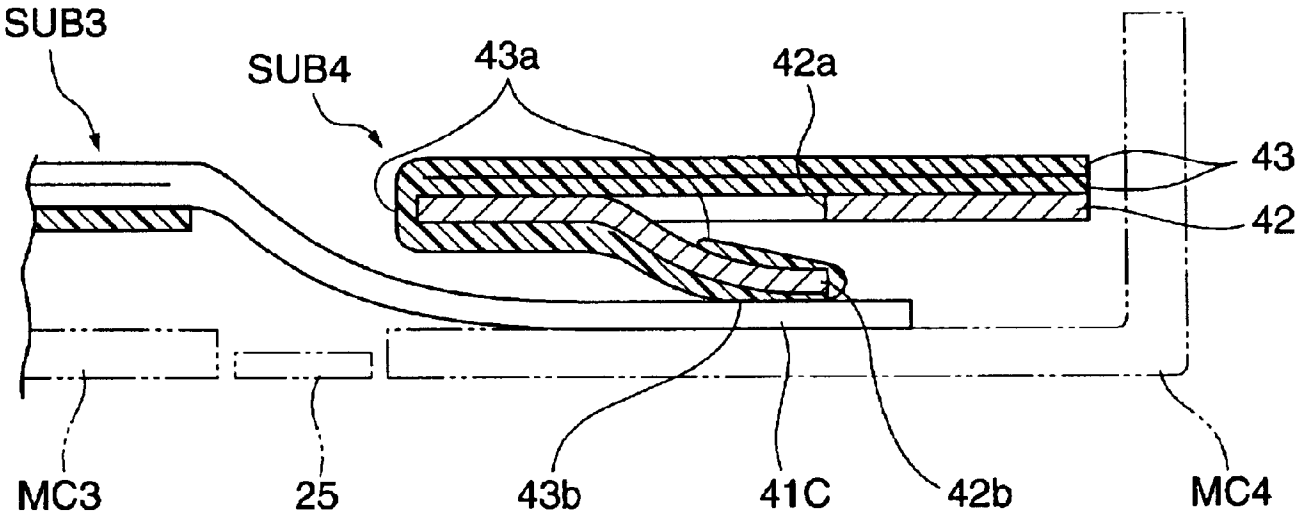
FIG. 9 is a cross-sectional view taken on line B—B in FIG. 8.

FIG. 7 is a cross-sectional view taken on line A—A in FIG. 1. FIG. 8 is a plan view of the sub-frame assembly SUB. FIG. 9 is a fragmentary sectional view taken on line B—B in FIG. 8.

As shown in FIG. 7, the sub-frame assembly SUB4 is comprised of a sub-frame 42 formed of a metal plate, such as an iron plate, and a membrane sheet member 43 formed of a flexible material. The membrane sheet member 43 has a known construction, and is comprised of an upper half and a lower half with switching portions 44, 45 being formed by dome portions defining dome-shaped spaces between the upper and lower halves. The switching portions 44, 45 are arranged in a manner associated with a white key WK and a black key BK, respectively, for detecting key depression and key release carried out on the keys. Further, in detecting key depression on a key, the dome portion of a corresponding one of the switch portions 44, 45 is deformed or buckled, which enables the player feel a click accompanied by a feeling of escapement. A front portion 42*d* of the sub-frame 42 has a lower limit stopper 42*c* integrally formed therewith, which defines a lower limit position of the white key WK when depressed with an excessively large force.

The fourth main case MC4 is formed therein with guide grooves 33, 34. The guide grooves 33, 34 extend substantially along the entire width of the fourth main case MC4 in the direction of the row of keys, and front and rear ends of the sub-frame 42 are slidably engaged with the guide grooves 33, 34, respectively, thereby allowing the sub-fame assembly SUB4 to slide along the row of keys. The sub-frame assembly SUB4 can be moved by holding the key range shift operating element 11R by hand and moving the same leftward or rightward. That is, the key range shift operating element 11R also serves as a grip to be gripped in slidingly moving the sub-frame assembly SUB4, and is thus commonly used for shifting the key range and for sliding the sub-frame assembly SUB4, which contributes to simplification of the construction of the keyboard apparatus 1.

The sub-frame assembly SUB1 is also configured identically or similarly to the sub-frame assembly SUB4. Further, in the case of the sub-frame assembly SUB1, the key range shift operating element 11L also serves as a grip for slidingly moving the sub-frame assembly SUB1. The sub-fame assemblies SUB2, SUB3 are also configured identically or similarly to the sub-frame assembly SUB4, except for the guide grooves 33, 34.

As shown in FIG. 8, the four sub-frame assemblies SUB1 to SUB4 are separate from each other at positions indicated by the one-dot chain lines DIV1, DIV2, DIV3 (shown on the keyboard section) in FIG. 1. However, the sub-frame assemblies SUB2, SUB3 are mechanically and electrically connected to each other by means of a flat cable 41B. From the sub-frame assembly SUB2 extends leftward a flat cable 41A, while from the sub-frame assembly SUB3 extends rightward a flat cable 41C.

As shown in FIG. 9, the sub-frame 42 has a cut-and-bent portion 42b which is cut and bent downward from a cut-out portion 42*a*. The membrane sheet member 43 extending on the sub-frame 42 has an extended portion 43*a* which turns around a left edge of the sub-frame 42 to extend underside the sub-frame 42, and is bonded to the cut-and-bent portion 42*b* in a fashion enclosing the same. The extended portion 43*a* has an electrode, not shown, provided on a lower surface 43*b* thereof. On the other hand, the flat cable 41C extending from the sub-frame SUB3 is bent downward to extend below the sub-frame assembly SUB4 and bonded to the bottom of the fourth main case MC4. An electrode, not shown, is provided on an upper surface of the flat cable 41C. The contact between this electrode and the electrode provided on the lower surface 43*b* of the extended portion 43*a* electrically connects the sub-frame assemblies SUB3 and SUB4 to each other via the flat cable 41C. The cut-and-bent portion 42*b* is urged downward by its own resilience, and hence, even when the sub-frame assembly SUB4 is slid in the direction of the row of keys, the electrodes are always kept in contact with each other.

Further, the sub-frame assembly SUB1 is also configured identically or similarly, and the sub-frame assemblies SUB1, SUB2 are always electrically connected to each other via the flat cable 41A. It should be noted that the electrical connection between the sub-frame assemblies SUB3 and SUB4 and that between the sub-frame assemblies SUB1 and SUB2 described above are not limitative, but the electrical connection may be established by a combination of a brush-shaped movable electrode and a fixed electrode, which are employed in a rotary encoder or the like.

As shown in FIG. 7, the keyboard unit KU4 is arranged above the sub-frame assembly SUB4. The keyboard unit KU4 is formed by a laminate of the white key unit KU4W and the black key unit KU4B placed thereon. That is, a key base portion KU4Wa of the white key unit KU4W is arranged on a rear portion 42*e* of the sub-frame 42 via the membrane sheet member 43, and further, a key base portion KU4Ba of the black key unit KU4B is arranged on the key base portion KU4Wa, with the key base portions KU4Wa and KU4Ba being fixed to a rear portion of the sub-frame assembly SUB4 by a screw 46.

The white key unit KU4W and the black key unit KU4B are both formed by blanking a flat plate of a synthetic resin, and is configured to have as small a thickness as possible insofar as no inconvenience is caused in performance operations (e.g. 2 mm, preferably 5 mm or less). Further, both the units KU4W, KU4B are formed such that almost all surface areas thereof visible from right above are substantially flat. These configurations minimize the thickness of the white keys WK and the black keys BK, thereby reducing the vertical dimension of the keyboard apparatus 1.

In the present embodiment, in both of the key units KU4W, KU4B, respective key-operating portions WKa, BKa (frontward of a hinge of the key) of each white key WK and each black key BK are formed to have the same thickness as key base end portions KU4Wa, KU4Ba. This makes it easy to make a keyboard unit which is in the form of comb teeth by blanking a flat plate. Further, the key units can be assembled only by laminating the black key unit KU4B on the white key unit KU4W and fixing them together, which facilitates the assembly work. Further, due to the thickness of the black key unit KU4B itself, the black key BK naturally protrudes above the white key WK (by about 2 mm), to present a feature characteristic of the black key, thereby allowing the user to perform blind operation. It should be noted that the key units KU4W and KU4B may be made by molding.

The white key WK and the black key BK have actuators KU4Wb, KU4Bb attached to underside surfaces WKb, BKb thereof, respectively. When the white key WK or the black key BK is depressed, the actuator KU4Wb or KU4Bb turns on the switch portion 44 or 45 of the membrane sheet 43, whereby the key-depressing operation is detected. A key-release operation is detected through operations carried out reversely to the above.

The other keyboard units KU1 to KU3 are basically configured identically or similarly to the keyboard unit KU4, but are different in kind of keys due to different pitches of tones to be generated.

More specifically, as shown in FIG. 1, a C key to an F key, a G key to a C key, a D key to a G key, and an A key to a C key are arranged in the keyboard units KU1, KU2, KU3, and KU4, respectively. In the present embodiment, to make the keyboard units KU1 to KU4 as uniform in length in the direction of the row of keys as possible, the black keys to be positioned between the units, i.e. an F# key, a G# key, and a G# key are arranged on the keyboard units KU2, KU3, and KU4, respectively. These black keys, however, may be each arranged on either of two adjacent key units.

According to the above configuration, the numbers of white keys in the keyboard units KU1, KU2, KU3, KU4 are "4, 4, 4, 3", respectively, and the total number of white and black keys is 25. The 25-key arrangement from C key to C key covers a tone range for a large number of tunes and causes little inconvenience in the performance even with the small number of keys, without excessively limiting the use of the keyboard apparatus.

Figure 10:
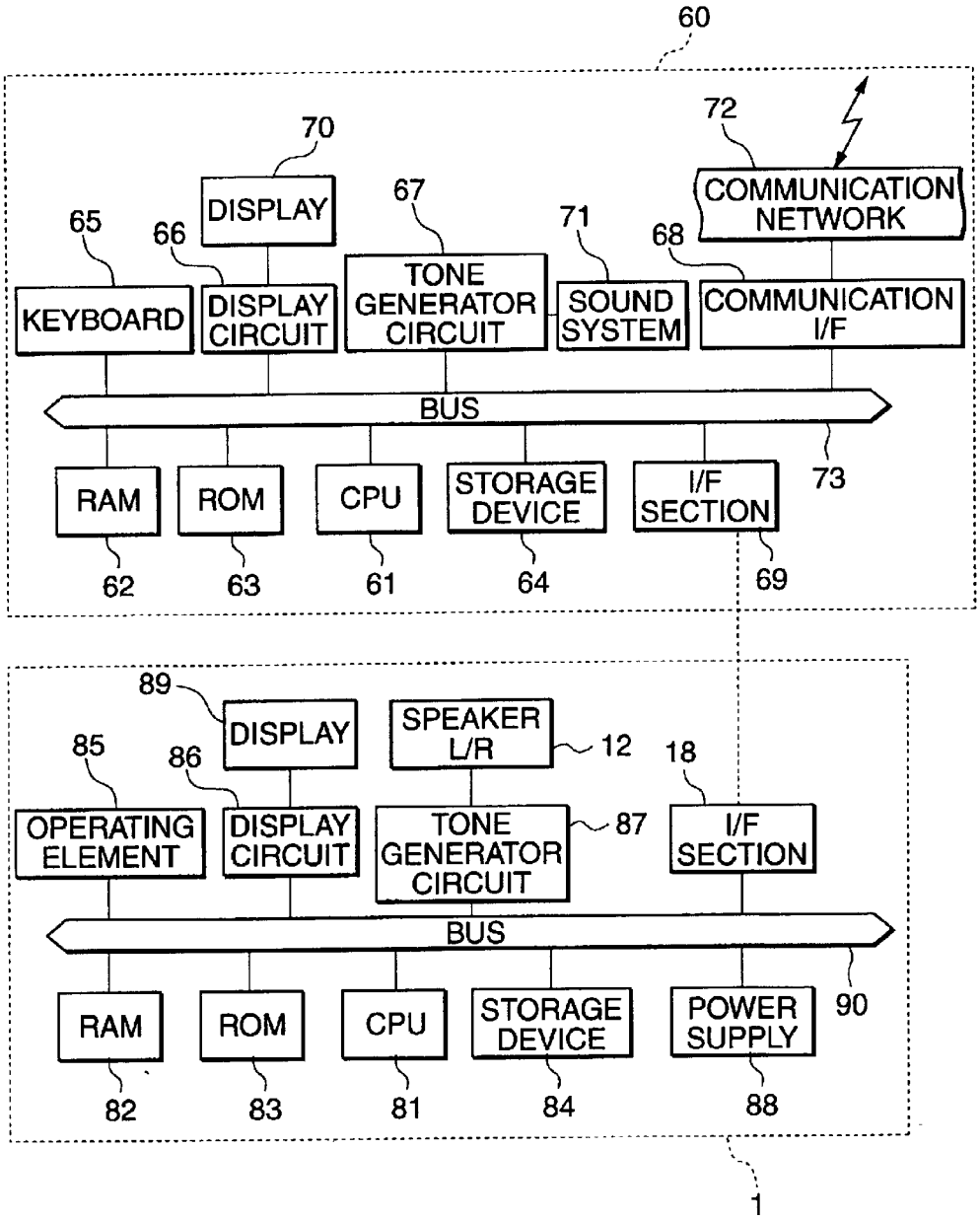
FIG. 10 is a block diagram showing the whole arrangement of a mobile keyboard system having the keyboard apparatus connected to a mobile computer.

FIG. 10 is a block diagram showing the whole arrangement of a mobile keyboard system in which the present keyboard apparatus 1 is connected to a mobile computer 60.

The mobile computer 60, illustrated by way of example, is comprised of a CPU 61, a RAM 62, a ROM 63, a storage device 64, a keyboard 65, a display circuit 66, a tone generator circuit 67, a communication I/F (interface) 68, I/F (interface) section 69, and a bus 73 connecting these components to each other. Further, the display circuit 66 has a display 70, such as an LCD, connected thereto, and the tone generator circuit 67 has a sound system 71 connected thereto. The communication I/F 68 enables connection to a distribution server or other computers or the like, via a communication network 72.

The CPU 61 controls the overall operation of the mobile computer 60. The RAM 62 stores various data, and also works as a working area for the CPU 61. The ROM 63 stores control programs and the like to be executed by the CPU 61. The storage device 64 is implemented by a RAM or a hard disk, and stores performance data and the like. The display circuit 66 causes various kinds of information to be visibly displayed on the display 70. The display 70 displays an edit screen or the like, for editing e.g. automatic performance data, musical tone data, etc., and also enables input data to be viewed.

The present keyboard apparatus 1 is comprised of a CPU 81, a RAM 82, a ROM 83, a storage device 84, operating elements 85, a display circuit 86, a tone generator circuit 87, a power supply 88 including e.g. electric cells, the aforementioned I/F (interface) section 18, and a bus 90 connecting these components to each other. Further, the display circuit 86 has the aforementioned display 89 connected thereto, the tone generator circuit 87 has the aforementioned speakers 12L, 12R connected thereto. The operating elements 85 include the key range shift operating element 11L, 11R, the switching portions 44, 45, and the groups of operating elements 14, 15, referred to hereinabove.

The CPU 81 controls the overall operation of the keyboard apparatus 1. The RAM 82 stores various data and also functions as a working area for the CPU 81. The ROM 83 stores control programs and the like to be executed by the CPU 81. The storage device 84 is implemented by a RAM or the like. The display circuit 86 causes various kinds of information to be visually displayed on the display 89. The tone generator circuit 87 generates a musical tone signal in accordance with depression of keys, and the speakers 12L, 12R convert the musical signal into a musical tone, whereby sounding is performed.

The present mobile keyboard system is constructed by connecting the I/F section 18 of the keyboard apparatus 1 and the I/F section 69 of the mobile computer 60 to each other. These interfaces may be implemented by USB (Universal Serial Bus), IEEE (Institute of Electrical and Electronic Engineers (I triple E)) 1394, or the like.

Figure 11:
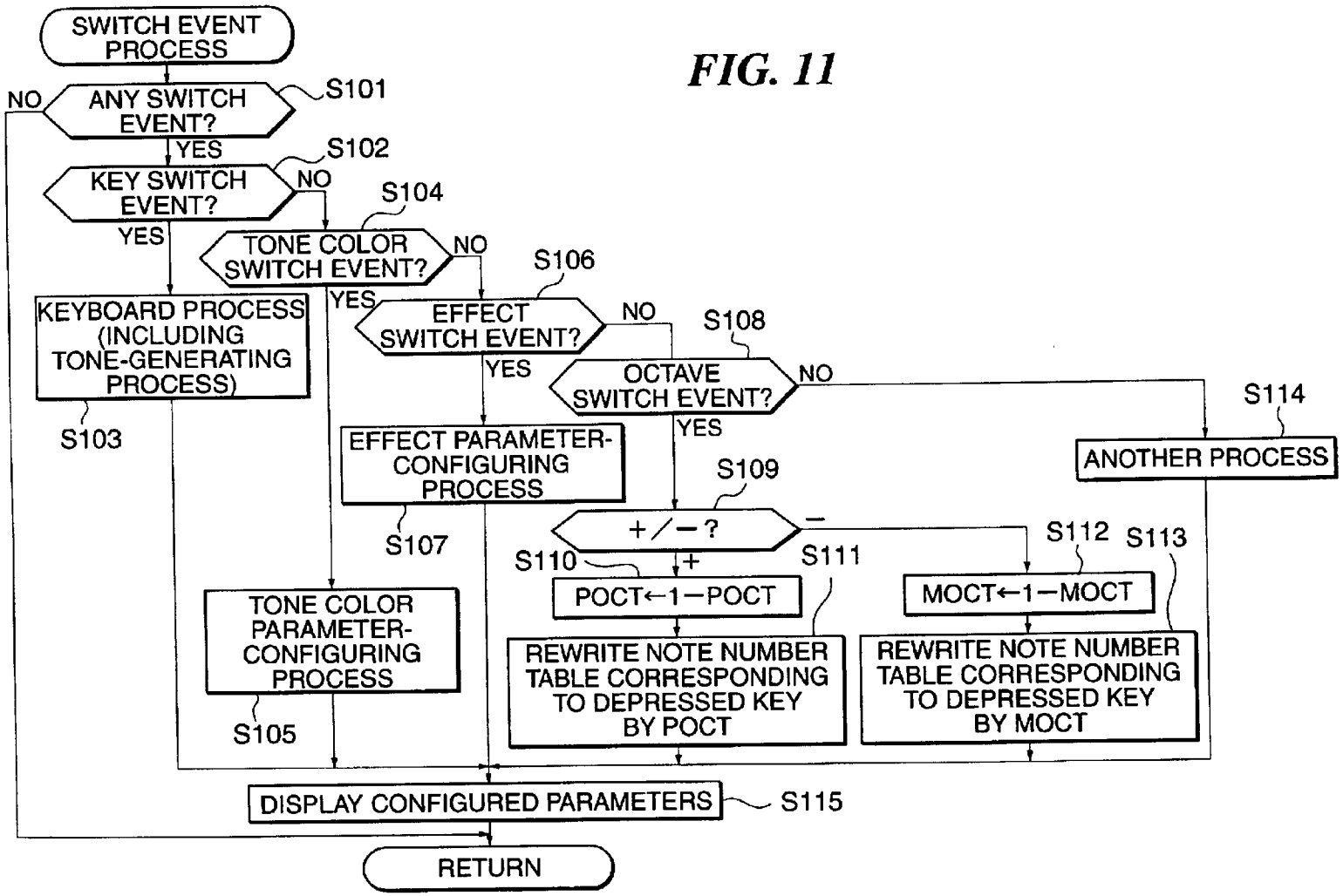
FIG. 11 is a flowchart showing a process for processing various switch events occurring in the mobile keyboard system.

FIG. 11 is a flowchart showing a process for processing various switch events, which is carried out by the mobile keyboard system. This process is executed by the CPU 61.

It is determined in a step S101 whether or not any switch (SW) event has occurred. If it is determined that no switch event has occurred, the present process is immediately terminated, whereas if it is determined that any switch event has occurred, it is determined in a step S102 whether or not the switch event is a key switch event (on or off event of the switch portion 44 or 45).

If it is determined that the switch event is a key switch event, a keyboard process is executed in a step S103, and the process proceeds to a step S115. In the keyboard process, a tone-generating or tone-attenuating process is carried out according to the depressed key. On the other hand, if it is determined that the switch event is not a key switch event, it is determined in a step S104 whether or not the switch event is a tone color switch event.

If it is determined that the switch event is a tone color switch event, a process for configuring (changing or setting) a corresponding one of various tone color parameters is executed in a step S105, and then the process proceeds to the step S115. On the other hand, if it is determined that the switch event is not a tone color switch event, it is determined in a step S106 whether or not the switch event is an effect switch event.

If it is determined that the switch event is an effect switch event, a process for configuring (changing or setting)a corresponding one of various effect parameters is executed in a step S107, and then the process proceeds to the step S115. On the other hand, if the switch event is not an effect switch event, it is determined in a step S108 whether or not the switch event is an octave switch event, that is, whether or not it is an on event caused by operation of either of the key range shift operating elements 11L and 11R.

If it is determined that the switch event is an octave switch event, it is determined in a step S109 which of an on event caused by operation of the key range shift operating element 11L (−) or an on event caused by operation of the key range shift operating element 11R (+) the octave switch event is. If it is determined that the octave switch event is an on event caused by operation of the key range shift operating element 11R (+), a variable POCT is set to "1−POCT" in a step S110, and a note number table corresponding to the depressed key is rewritten by using the variable POCT in a step S111, and then the process proceeds to the step S115. This enables the range of tones to be generated by depression of a key to be switched between an initial range and a range shifted toward the higher pitch side by one octave whenever the key range shift operating element 11R is depressed.

On the other hand, if it is determined in the step S109 that the octave switch event is an on event caused by operation of the key range shift operating element 11L (−), a variable MOCT is set to "1−MOCT" in a step S112, and a note number table corresponding to the depressed key is rewritten by using the variable MOCT in a step S113, and then the process proceeds to the step S115. This enables the range of tones to be generated by depression of a key to be switched between an initial range and a range shifted toward the lower pitch side by one octave whenever the key range shift operating element 11L is depressed.

On the other hand, if it is determined in the step S108 that the switch event is not an octave switch event, another process corresponding to the switch event is executed in a step S114, and then the process proceeds to the step S115. In this other process, musical tone data is transmitted to and received from an external device by connecting the present apparatus to the Internet, or automatic accompaniment is reproduced, for example. Besides these, real time performance, step input of musical tone data, a change of modes, and so forth are also carried out in the other process.

In the step S115, the configured parameter or parameters are displayed on the display 70 thereby allowing the user to view the same, followed by terminating the present process. After termination of the present process, the program returns to the start of the main routine, and an event process is performed.

It should be noted that the present keyboard apparatus 1 may be connected to another device or apparatus, such as a cellular phone, a PHS (personal handy phone system), or a PDA (personal digital assistant), and transmission and reception of data or the production of music may be carried out by making use of a communication capability or an information processing capability thereof. It goes without saying that the keyboard apparatus 1 can be also played singly to produce tones in a simplified fashion, without being connected to the mobile computer 60 or the like. Even in such a case, compared with the combined arrangement of the keyboard apparatus 1 and the mobile computer 60 or the like, the single unit of the keyboard apparatus 1 merely suffers from lowered abundance of tone colors, a reduced number of control parameters, and the like.

According to the present embodiment, adjacent pairs of the four main cases MC1 to MC4 are pivotally connected by the connecting portions CON1, CON2, CON3, to allow them to be relatively pivoted from the folded state to the flat unfolded state. This improves the rigidity and durability of the keyboard apparatus 1 compared with the bending of a sheet-shaped keyboard into a folded state. Further, the main cases MC1 to MC4 are configured to assume two positions, i.e. the folded position and the flat unfolded position. This makes it possible to make the keyboard apparatus compact in size when the main cases are in the folded position and carry the same with the main cases in the folded position, and play the same with the main cases in the flat unfolded position. Furthermore, each keyboard unit KU is arranged not on a soft sheet but on a main case MC having a certain degree of hardness, which makes it easy to perform key-depressing operation. Further, since the three main cases MC1 to MC3 for the lower tone ranges are each configured to have four white keys arranged thereon, it is easy to make these main cases uniform in length in the direction of the row of keys, which facilitates designing the keyboard apparatus in a compact form to thereby enhance portability. It should be noted that the number of keys (the total of white and black keys) to be arranged on the main case MC4 for the highest range is not limited to 5. For example, by using the same main cases MC1 to MC4 and varying the number of keys to be arranged on the main case MC4, it is possible to carry out multi-model production. Further, in the present embodiment, since the C key-to-C key arrangement of 25 keys is employed, it is possible to cover a wide tone range for a large number of tunes, causing little inconvenience in the performance, without excessively limiting the use of the keyboard apparatus. Therefore, it is possible to adapt the keyboard apparatus 1 to a wide range of musical scenes.

Thus, the present keyboard apparatus 1 has a high durability, portability, and operability, and can be easily adapted to a wide range of musical scenes and multi-model production.

It should be noted that the adaptation to a wide range of musical scenes is possible even when the number of white keys arranged on the main case MC4 for the highest tone range is 2 and the total number of keys is 24. For example, if the 24 keys are in the F key-to-E key arrangement or the C key-to-B key arrangement, it is possible to cover a tone range for a larger number of tunes. Further, the keyboard arrangement may be set such that the main case MC4 has no white keys arranged thereon, and the total number of white and black keys is 20. Even in this case, the keyboard apparatus can be adapted to a relatively wide range of musical scenes. For example, an F key-to-C key arrangement makes it possible to cover a tone range of a large number of tunes. Thus, the arrangement of "4, 4, 4, . . . " in the number of white keys from the lowest tone range side ensures provision of at least 20 keys in total of white and black keys, so that it is easy to adapt the keyboard apparatus to a wide range of musical scenes.

Further, in the present embodiment, the group of operating elements 15 for tone colors and effects, which are operating elements other than the keys, are arranged on the main case MC4 on the highest pitch side, which makes it possible to make effective use of limited space. That is, it is not required to provide any keys on the main case MC4 when the total number of keys arranged on the keyboard apparatus is 20, and only required to provide two white keys when the same is 24, and three white keys when the same is 25. Assuming that the four main cases MC1 to MC4 are made uniform in length in the direction of the row of keys, in any of the above cases, unused space is produced in the main case MC4. However, by arranging the group of operating elements 15 other than the keys in the unused space, it is possible to lay out the operating elements without increasing the whole size of the keyboard apparatus 1. Therefore, through the effective use of unused space, the keyboard apparatus 1 can be made more compact in size, thereby enhancing portability of the same.

Also in the present embodiment, in each of the keyboard units KU1 to KU4, white keys WK and black keys BK have a thickness equal to or smaller than 5 mm, and are formed such that almost all surface areas thereof visible from right above are substantially flat. This makes it possible to minimize the thickness of each key and reduce the vertical dimension of the keyboard apparatus, thereby enhancing portability of the same.

Moreover, since each of the keyboard units KU1 to KU4 is formed by laminating the key base portion KUBa (each of KU1Ba to KU4Ba) as a common base portion of black keys BK on the key base portion KUWa (a corresponding one of KU1Wa to KU4Wa)as a common base portion of white keys WK, each of the keyboard units KU1 to KU4 can be assembled only by laminating the two key base portions KUWa and KUWb, which facilitates the assembly work of keyboard units. What is more, since the keyboard units KU1W to KU4W, KU1B to KU4B are configured to be flat, it is possible not only to reduce the thickness of white and black keys to thereby reduce the vertical dimension of the keyboard apparatus, but also to manufacture the keyboard units by blanking a flat plate or the like to thereby simplify the configuration and manufacturing of the keyboard apparatus. This makes it possible to facilitate manufacture of the keyboard apparatus by simplifying the configuration and assembly thereof while maintaining a high durability, portability, and operability.

Further, the only work of laminating each of the key base portion KU1Ba to KU4Ba of the black key unit KU1B to KU4B on the corresponding one of the key base unit KU1Wa to KU4Wa of the while key unit KU1W to KU4W automatically produces a difference in height between the white keys WK and the black keys BK by the thickness of the black key units KU1B to KU4B, whereby the black keys BK can protrude above the white keys WK as in the ordinary keyboard. This causes the black keys BK to present a feature characteristic of the black key, thereby allowing the user to perform blind operation. Thus, it is possible to enhance operability of the keyboard apparatus by enabling blind operation of keys by the simple configuration and easy assembly work.

In the present embodiment, since the key range shift operating elements 11 are provided, the range of tones that can be sounded is widened, and what is more, since the key range shift operating elements 11 are arranged on the left end MC1*a* of the main case MC1 for the lowest tone range and the right end MC4a of the main case MC4 for the highest tone range, they are easy to operate. Further, since the key range shift operating elements 11L and 11R are disposed and configured to also serve as grips held by hand for slidingly moving the sub-frame assemblies SUB1, SUB4, the configuration can be made simpler than when the key range shift operating elements and the grips are separately provided. Therefore, the keyboard apparatus has a high durability, portability, and operability, and is capable of covering a wide tone range by the simple configuration and a reduced number of keys.

According to the present embodiment, the speakers 12L, 12R are arranged at the left and right ends MC1*a*, MC4*a* of the main cases MC1, MC4 and at locations rearward of the keyboard units KU1, KU4. This prevents the speakers 12L and 12R from obstructing the sliding of the keyboard units KU1, KU4 along the row of keys when the keyboard apparatus is changed between the folded position of the main cases and the flat unfolded position of the same. Thus, the speakers 12L, 12R are arranged without wastefully using the limited space, which contributes to making the keyboard apparatus compact in size, and hence the portability of the device is maintained. This makes it possible to generate tones by depression of keys, while maintaining a high durability, portability, and operability. Further, when the keyboard apparatus 1 is in the flat unfolded position of the main cases, the speakers 12L, 12R are positioned at the respective outermost ends of the keyboard apparatus 1, which is the most effective position for the purpose of stereophonic tone generation, thereby providing excellent stereophonic effects.

Although in the present embodiment, each of the white key units KU1W to KU4W and an associated one of the black key units KU1B to KU4B are formed as separate members, this is not limitative, but they may be formed as a unitary member. In this case, after a flat plate is blanked, a black seal having a thickness of about 5 mm may be affixed to a top surface of an area of the white key unit corresponding to the black key unit. This causes the black key to be positively visually recognized, and at the same time protruded above the white key to facilitate blind operation.

Although in the above embodiment, both of the white key units and black key units are formed to have a flat plate shape, this is not limitative, but either of them may be formed as such, and they need not have the same thickness. The keyboard apparatus 1 may have only one of the two key range shift operating elements 11L and 11R.

(Second Embodiment)

Figure 12:
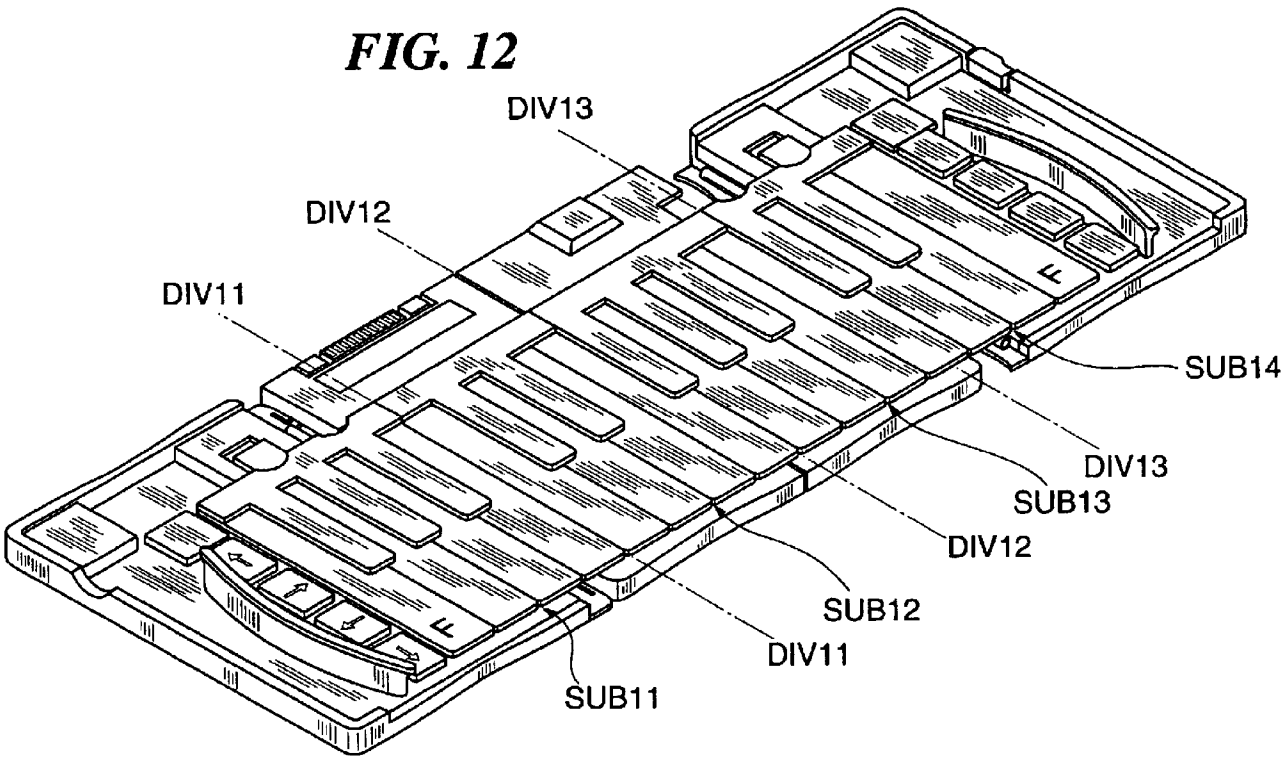
FIG. 12 is a perspective view showing the appearance of a keyboard apparatus according to a second embodiment of the present invention.

FIG. 12 is a perspective view of the appearance of a keyboard apparatus according to a second embodiment of the present invention.

The present embodiment is distinguished from the first embodiment described above in which the C key-to-C key arrangement of 25 keys is provided by way of example, in that an F key-to-F key arrangement of 25 keys is provided. The basic arrangement of sub-frame assemblies and keyboard units are the same as those of the first embodiment, but only different in dividing positions of the main frames. In the second embodiment, as shown in FIG. 12, sub-frame assemblies SUB11 and SUB12, sub-frame assemblies SUB12 and SUB13, and sub-frame assemblies SUB13 and SUB14 are divided at positions indicated by one-dot chain lines DIV11, DIV12, and DIV13, respectively. The other configurations are the same as those of the first embodiment.

The present embodiment can provide substantially the same advantageous effects as provided by the first embodiment.

It should be noted that the number of white keys to be arranged in a keyboard unit associated with the sub-frame assembly SUB14 may be any of 0 to 4, and if the number of white keys is set to two, with the total number of keys being set to 24, it is idealistic to employ an F key-to-E key arrangement.

Although in the above first and second embodiments, the number of main cases is four, this is not limitative, but at least two (including four or more) main cases may be provided and configured to be foldable by a suitable combination of connecting portions exemplified by those CON1 to CON3 of the first embodiment.

Figure 13:
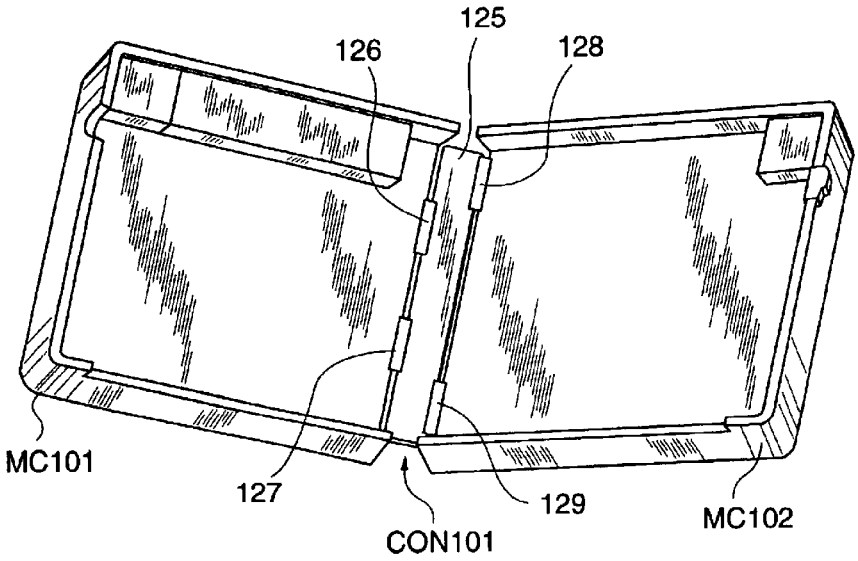
FIG. 13 is a view schematically showing an example of the construction of the keyboard apparatus using two main cases.

For example, as shown in FIG. 13, two main cases MC101 and MC102 may be pivotally connected at a connecting portion 101 which is comprised of a connecting piece 123 and hinges 126, 127, 128, 129. It should be noted that this figure only schematically shows the configuration of the main cases, and other components including keyboard units associated therewith are omitted from the illustration.

What is claimed is:

1. A keyboard apparatus comprising:

a plurality of keys arranged in a row;

four frames each having part of said keys arranged thereon, said four frames including three frames for lower tone ranges;

four keyboard units each having part of said plurality of keys integrally formed thereon and covering a predetermined tone range, said four keyboard units being arranged above said four frames, respectively; and connecting means connecting adjacent pairs of said four frames in a manner allowing each adjacent pair to be pivoted relative to each other from a folded state to a flat unfolded state, whereby said four frames are allowed by said connecting means to assume a folded position in which said four frames are folded into a size substantially as large as a size of one frame, and a flat unfolded position in which said four frames are unfolded and extend serially in a direction of the row of said keys, wherein said keys include four white keys arranged on said three frames for the lower tone ranges, wherein said four frames includes one frame for a highest tone range, and wherein said one frame has at least two white keys arranged thereon, wherein said one frame has at least one operating element other than said keys arranged thereon, and wherein two of said keyboard units at laterally opposite ends of the keyboard apparatus are slidable relative to the frames associated therewith when said four frames are being folded or unfolded.

2. The keyboard apparatus of claim 1, wherein the keys are elongated fitting for a musical keyboard, and wherein said keys are positioned above said connecting means when said frames are in the flat unfolded position.

3. A keyboard apparatus comprising:

a plurality of keys arranged in a row, said keys comprising white keys and black keys;

four frames each having a plurality of said white keys and a plurality of said black keys arranged thereon, said four frames including three frames for lower tone ranges, said three frames for the lower tone ranges each include no more than four white keys; and connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys;

wherein said black keys arranged on each of said frames have a thickness of not larger than 5 mm, said black keys being formed such that substantially all surface areas thereof visible from right above are located substantially on a plane.

4. The keyboard apparatus of claim 3, wherein the keys are elongated fitting for a musical keyboard, and wherein said keys are positioned above said connecting means when said frames are in the flat unfolded position.

5. A keyboard apparatus comprising:

a plurality of keysarranged in a row, said keys comprising white keys and black keys;

four frames each having a part of the keys arranged thereon, said four frames including three frames for lower tone ranges;

connecting means connecting adjacent pairs of said frames in a manner allowing each adjacent pair to be pivoted relative to each other from a folded state to a flat unfolded state, whereby said frames aic allowed by said connecting means to assume a folded position in which said frames are folded into a size substantially as large as a size of one frame, and a flat unfolded position in which said frames are unfolded and extend serially in a direction of the row of said keys; and a plurality of keyboard units arranged on said frames, respectively, each of said keyboard units having a white key unit and a black key unit, said white key unit having no more than four of said white keys having a common key base portion, and said blank key unit having a plurality of said black keys having a common key base portion, said white key unit and said black key unit being laminated upon each other via said common key base portions of said white keys and said black keys, wherein said white keys of said white key unit and said black keys of said black key unit have a thickness of not larger than 5 mm, said black white keys and said black keys being formed such that substantially all surface areas thereof visible from right above are located substantially on a plane.

6. The keyboard apparatus of claim 5, wherein the keys are elongated fitting for a musical keyboard, and wherein said keys are positioned above said connecting means when said frames are in the flat unfolded position.

7. A keyboard apparatus comprising:

a plurality of keys arranged in a row, said keys comprising white keys and black keys;

a plurality of frames;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys; and a plurality of keyboard units arranged on said frames, respectively, each of said keyboard units having a white key unit and a black key unit, said white key unit having a plurality of said white keys having a common key base portion, and said black key unit having a plurality of said black keys having a common key base portion, said white key unit and said black key unit being laminated upon each other via said common key base portions of said white keys and said black keys, wherein both of said white key unit and said black key unit are shaped in a flat plate form, and said key base portion of said black key unit is laminated on said key base portion of said white key unit such that the black keys protrude above the white keys.

8. A keyboard apparatus according to claim 7, wherein said white keys of said white key unit and said black keys of said black key unit have a thickness of not larger than 5 mm.

9. A keyboard apparatus comprising:

a plurality of keys arranged in a row, said keys comprising white keys and black keys;

a plurality of frames each having a plurality of said white keys and a plurality of said black keys arranged thereon, said frames including a frame for a lowest tone range having a left-hand end and a frame for a highest tone range having a right-hand end; and connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys; and at least one key range shift operating element arranged in a vicinity of at least one of said left-hand end of said frame for the lowest tone range and said right-hand end of said frame for the highest tone range, for changing pitch of a tone generated by key depression.

10. A keyboard apparatus comprising:

a plurality of keys arranged in a row;

at least one key range shift operating element for changing pitch of a tone generated by key depression;

a plurality of frames including a left-hand end frame and a right-hand end frame;

a plurality of keyboard units arranged on said frames, respectively and having said plurality of keys, said keyboard units including a left-hand end keyboard unit and a right-hand end keyboard unit associated with said left-hand end frame and said right-hand end frame, respectively;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys; and two grips arranged on said left-hand end keyboard unit and said right-hand end keyboard unit, respectively, for moving said left-hand end keyboard unit and said right-hand end keyboard unit, in the direction of the row of said keys, wherein said at least one key range shift operating element also serves as at least one of said two grips.

11. The keyboard apparatus of claim 10, wherein the keys are elongated fitting for a musical keyboard, and wherein said keys are positioned above said connecting means when said frames are in the flat unfolded position.

12. A keyboard apparatus comprising:

a plurality of keys arranged in a row;

a plurality of frames including a left-hand end frame and a right-hand end frame;

a plurality of keyboard units arranged on said frames, respectively and having said plurality of keys, said keyboard units including a left-hand end keyboard unit and a right-hand end keyboard unit associated with said left-hand end frame and said right-hand end frame, respectively;

musical tone-generating means for generating a musical tone signal in accordance with operation of each key on said keyboard units;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys; and two acoustic conversion devices arranged on said left-hand end frame and said right-hand end frame at locations rearward of said left-hand end keyboard unit and said right-hand end keyboard unit, for converting a musical tone signal generated by said musical tone-generating means into sound.

13. A keyboard apparatus according to claim 12, wherein said two acoustic conversion devices are positioned at a left-hand end of said left-band end frame and a right-hand end of said right-hand end frame, respectively, when said frames assume said unfolded position.

14. The keyboard apparatus of claim 12, wherein the keys are elongated fitting for a musical keyboard, and wherein said keys are positioned above said connecting means when said frames are in the flat unfolded position.

15. A keyboard apparatus comprising:

a plurality of elongated keys arranged in a row, said keys comprising white keys and black keys of a type for a musical keyboard;

four frames each having a plurality of said white keys and a plurality of said black keys arranged thereon, said four frames including three frames for lower tone ranges, said three frames for the lower tone ranges each include at least four white keys;

four keyboard units each, having part of said plurality of keys integrally formed thereon and covering a predetermined tone range, said four keyboard units being arranged above said four frames, respectively; and connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, wherein said keys are positioned above said connecting means when said frames are in the flat unfolded position, and wherein two of said keyboard units at laterally opposite ends of the keyboard apparatus are slidable relative to the frames associated therewith when said four frames are being folded or unfolded.

16. A keyboard apparatus comprising:

a plurality of elongated keys arranged in a row, said keys comprising white keys and black keys of a type for a musical keyboard;

four frames each having a part of the keys arranged thereon, said four frames including three frames for lower tone ranges;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys; and a plurality of keyboard units arranged on said frames, respectively, each of said keyboard units having a white key unit and a black key unit integrally formed thereon and covering a predetermined tone range, said white key unit having a plurality of said white keys having a common key base portion, and said black key unit having a plurality of said black keys having a common key base portion, said white key unit and said black key unit being laminated upon each other via said common key base portions of said white keys and said black keys, wherein said keys are positioned above said connecting means when said frames are in the flat unfolded position, and wherein two of said keyboard units at laterally opposite ends of the keyboard apparatus are slidabie relative to the frames associated therewith when said four frames are being folded or unfolded.

17. A keyboard apparatus comprising:

a plurality of elongated keys arranged in a row, said keys comprising white keys and black keys of a type for a musical keyboard;

at least one key range shift operating element for changing pitch of a tone generated by key depression;

four frames each having part of the keys arranged thereon, said four frames including a left-hand end frame and a right-hand end frame;

a plurality of keyboard units arranged on said frames, respectively and each having part of said plurality of keys integrally formed thereon and covering a predetermined tone range, said keyboard units including a left-hand end keyboard unit and a right-hand end keyboard unit associated with said left-hand end frame and said right-hand end frame, respectively; and connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys, wherein said keys are positioned above said connecting means when said frames are in the flat unfolded position, and wherein two of said keyboard units at laterally opposite ends of the keyboard apparatus are slidable relative to the frames associated therewith when said four frames are being folded or unfolded.

18. A keyboard apparatus comprising:

a plurality of elongated keys arranged in a row, said keys comprising white keys and black keys of a type for a musical keyboard;

four frames each having part of the keys arranged thereon, said four frames including a left-hand end frame and a right-hand end frame;

a plurality of keyboard units arranged on said frames, respectively and each having part of said plurality of keys integrally formed thereon and covering a predetermined tone range, said keyboard units including a left-hand end keyboard unit and a right-hand end keyboard unit associated with said left-hand end frame and said right-hand end frame, respectively;

musical tone-generating means for generating a musical tone signal in accordance with operation of each key on said keyboard units; and connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-band end frame and said right-hand end frames, respectively, in the direction of the row of said keys, wherein said keys are positioned above said connecting means when said frames are in the flat unfolded position, and wherein two of said keyboard units at laterally opposite ends of the keyboard apparatus are slidable relative to the frames associated therewith when said four frames are being folded or unfolded.

19. A keyboard apparatus comprising:

a plurality of keys arranged in a row;

a plurality of frames including a left-hand end frame and a right-hand end frame;

a plurality of keyboard units arranged on said frames, respectively and having said plurality of keys, said keyboard units including a left-hand end keyboard unit and a right-hand end keyboard unit associated with said left-hand end frame and said right-hand end frame, respectively;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys; and two finger grips arranged on said left-hand end keyboard unit and said right-hand end keyboard unit, respectively, for moving said left-hand end keyboard unit and said right-hand end keyboard unit, in the direction of the row of said keys, wherein said at least one key range shift operating element also serves as at least one of said two finger grips.

20. A keyboard apparatus comprising:

a plurality of keys arranged in a row;

a plurality of frames including a left-hand end frame and a right-hand end frame;

a plurality of keyboard units arranged on said frames, respectively and each having part of said plurality of keys integrally formed thereon and covering a predetermined tone range said keyboard units including a left-hand end keyboard unit and a right-hand end keyboard unit associated with said left-hand end frame and said right-hand end frame, respectively;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys; and a plurality of operating elements for setting musical tone parameters, wherein two of said keyboard units at laterally opposite ends of the keyboard apparatus are slidable relative to the frames associated therewith when said four frames are being folded or unfolded.

21. A keyboard apparatus comprising:

a plurality of keys arranged in a row;

a plurality of frames including a left-hand end frame and a right-hand end frame;

a plurality of keyboard units arranged on said frames, respectively and having said plurality of keys, said keyboard units including a left-hand end keyboard unit and a right-hand end keyboard unit associated with said left-hand end frame and said right-hand end frame, respectively, wherein each of said keyboard units include a subframe for mounting to the respective frames;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys, wherein said right-hand frame includes a plurality of grooves for slidably engaging the top and bottom edge of the subframe of said right-hand end keyboard unit, and wherein said left-hand frame includes a plurality of grooves for slidably engaging the top and bottom edges of the subframe of said left-hand end keyboard unit.

22. A keyboard apparatus comprising:

a plurality of keys arranged in a row;

a plurality of frames including a left-hand end frame and a right-hand end frame;

a plurality of keyboard units arranged on said frames, respectively and having said plurality of keys, said keyboard units including a left-hand end keyboard unit and a right-hand end keyboard unit associated with said left-hand end frame and said right-hand end frame, respectively;

connecting means connecting adjacent pairs of said frames in a manner allowing each adjacent pair to be pivoted relative to each other from a folded state to a flat unfolded state, whereby said frames are allowed by said connecting means to assume a folded position in which said frames are folded into a size substantially as large as a size of one frame, and a flat unfolded position in which said frames are unfolded and extend serially in a direction of the row of said keys, by moving said left-hand end keyboard unit and said right-hand end keyboard unit relative to said left-hand end frame and said right-hand end frames, respectively, in the direction of the row of said keys, wherein said right-hand and left-hand frames each include an engagement piece for securely engaging a top portion of the right-hand end and left-hand end keyboard unit, respectively, when the keyboard is in a flat unfolded position.

* * * * *